US008035568B2

(12) United States Patent
Diaz et al.

(10) Patent No.: US 8,035,568 B2
(45) Date of Patent: Oct. 11, 2011

(54) ELECTROMAGNETIC REACTIVE EDGE TREATMENT

(75) Inventors: Rodolfo E. Diaz, Phoenix, AZ (US); William E. McKinzie, III, Fulton, MD (US)

(73) Assignee: Wemtec, Inc., Fulton, MD (US)

( * ) Notice: Subject to any disclaimer, the term of this patent is extended or adjusted under 35 U.S.C. 154(b) by 0 days.

(21) Appl. No.: 12/818,771

(22) Filed: Jun. 18, 2010

(65) Prior Publication Data

US 2010/0315302 A1 Dec. 16, 2010

Related U.S. Application Data

(62) Division of application No. 11/998,316, filed on Nov. 29, 2007, now Pat. No. 7,764,241.

(60) Provisional application No. 60/872,082, filed on Nov. 30, 2006.

(51) Int. Cl.
*H01Q 7/00* (2006.01)

(52) U.S. Cl. ..... 343/742; 343/787; 343/744

(58) Field of Classification Search ..... 343/742, 343/787, 744

See application file for complete search history.

(56) References Cited

U.S. PATENT DOCUMENTS

| | | | | |
|---|---|---|---|---|
| 5,606,335 | A | 2/1997 | English et al. | |
| 5,900,842 | A | 5/1999 | Coleman | |
| 5,977,921 | A * | 11/1999 | Niccolai et al. | 343/741 |
| 6,150,895 | A * | 11/2000 | Steigerwald et al. | 333/12 |
| H2028 | H | 6/2002 | Koscica et al. | |
| 6,404,391 | B1 | 6/2002 | Apostolos | |
| 6,653,982 | B2 * | 11/2003 | Lindenmeier et al. | 343/741 |
| 6,933,895 | B2 * | 8/2005 | Mendolia et al. | 343/702 |
| 6,937,192 | B2 | 8/2005 | Mendolia et al. | |
| 6,960,984 | B1 | 11/2005 | Vicci et al. | |

OTHER PUBLICATIONS

Clavijo, Sergio A., "*Diffraction Control for Electrically Small Low-Profile Antennas*," Ph.D. dissertation, Electrical Engineering Department, Arizona State University, Dec. 2005, pp. 52-69.

Munk, B., "*Finite Antenna Arrays and FSS*," John Wiley and Sons, Inc., 2003, pp. 261-268.

Apr. 16, 2009 Non-Final Office Action, U.S. Appl. No. 11/998,316 (15 pages).

Response to Apr. 16, 2009 Non-Final Office Action, U.S. Appl. No. 11/998,316, filed in the PTO on May 28, 2009 (6 pages).

Sep. 3, 2009 Non-Final Office Action, U.S. Appl. No. 11/998,316 (12 pages).

Response to Sep. 3, 2009 Non-Final Office Action, U.S. Appl. No. 11/998,316, filed in the PTO on Jan. 4, 2010 (5 pages).

* cited by examiner

*Primary Examiner* — Shawki Ismail
*Assistant Examiner* — Crystal L Hammond
(74) *Attorney, Agent, or Firm* — Brinks Hofer Gilson & Lione

(57) ABSTRACT

An electromagnetic reactive edge treatment including an array of capacitively-loaded loops is disposed at or near an edge of a conductive wedge. The axes of the loops are oriented parallel to the edge of the wedge. This edge treatment may enhance or suppress the hard diffraction coefficient, depending on the resonant frequency $f_o$ of the array of loaded loops. Diffraction of incident waves that are lower (higher) in frequency than $f_o$ may be enhanced (suppressed) due to the increase (decrease) in effective permeability of the volume occupied by the array of loops. Applications include controlling antenna patterns, side lobe levels, and backlobe levels for antennas mounted on conductive surfaces near edges or corners.

10 Claims, 23 Drawing Sheets

Original. No loop

With Loop: Size=8 gap=5

Workspace:
$0 < x < 3000$ mils
$-P/2 < y < P/2$
$-1000 < z < 1000$ mils

The period P of the unit cell is either 200 mils or 400 mils (y direction)

Boundary Conditions:
ABCs for xmin, xmax, zmin, and zmax.
H-walls for ymin and ymax.

ELECTROMAGNETIC REACTIVE EDGE TREATMENT

The application is a divisional application of U.S. Ser. No. 11/998,316, which was filed on Nov. 29, 2007 now U.S. Pat. No. 7,764,241 and which claims the benefit of benefit of U.S. Provisional application No. 60/872,082, entitled "Reactive Edge Treatment," filed on Nov. 30, 2006, each of which is incorporated herein by reference.

TECHNICAL FIELD

This application relates generally to systems and methods for controlling diffraction of electromagnetic waves from metal edges and corners.

BACKGROUND

Antennas are often installed on conducting surfaces that are usually called ground planes. In many applications the ground plane is finite and is often terminated by an edge in the form of a sharp bend or corner. In the limiting case where the included angle of the bend goes to zero, there is a knife edge or half-plane. A radiating antenna will usually excite TM (transverse magnetic relative to the plane of incidence) mode waves which will travel along the ground plane with the Electric field (E field) normal to the surface until an edge reached. Then the TM wave will diffract, resulting in electromagnetic power being scattered into shadow regions, such as below the antenna ground plane. Such radiation into the shadow region is known as a backlobe. Edge diffraction may also result in increased side lobe levels (SLL) for directive antennas, when compared with a case where the ground plane is substantially infinite in planar size.

Edge diffraction is also responsible for a certain amount of spill-over loss in feed antennas (horns or patch arrays) for reflector, lens, or other quasi-optical antenna systems.

One means of suppressing edge diffraction for half-planes is to use a tapered periodic surface (TPS). This is a class of patterned, quasi-periodic, conductive surface where the period changes with distance from the edge such that the surface impedance gradually transforms from the essentially a zero surface impedance of a good ground plane to an infinite surface impedance beyond the edge. (TPS are described by Munk in section 9.6, *Finite Antenna Arrays and FSS,* 2003, John Wiley and Sons. Also, see U.S. Pat. No. 5,606,335 by Errol K. English et al.) A TPS generally requires a dedicated area along the edge whose width is a minimum of two or more wavelengths. Many antennas reside on very small ground planes where there is not enough space to use a TPS. A TPS can be used for a half-plane and not, for example, on a conducting wedge of non-zero included angle.

Resistive cards (R-card) have sometimes been used at edges of conductive ground planes to mitigate diffraction. However, the R-card material must be located at least one half of a free-space wavelength away from the edge of the antenna to avoid degradation of antenna radiation efficiency. Furthermore, R-card treatments must be augmented with volumetric absorbers (so-called radar absorbing material) in the case where the ground plane edge is not a half-plane but a corner with non-zero dihedral angle.

Magnetically-loaded radar absorbing material (MAGRAM) has been used at edges to suppress edge diffraction. However, this material is also RF lossy as it is composed of an iron or ferrite loaded insulator such as rubber or silicone. It is relatively heavy, and it cannot be used in the near field of an antenna without degrading the antenna radiation efficiency.

There exist certain situations where the enhancement of the diffraction coefficient is needed to improve the electromagnetic coupling around a corner. For instance, this may be desirable to obtain a more omni-directional antenna pattern for a communication antenna mounted on the side of a building. None of the above methods (TPS, R-card, or MAGRAM) will enhance the diffraction coefficient at an edge.

SUMMARY

Herein, a method and apparatus either to suppress or enhance the scattering of electromagnetic waves from edges formed by conductive wedges of arbitrary dihedral angle is disclosed.

An apparatus is disclosed, including an electrically conductive structure having an edge; and, a reactive region disposed substantially adjacent to the edge. The reactive region produces a lower relative magnetic permeability in a first frequency band above a design frequency, and a higher relative permeability in a second frequency band below a design frequency. In an aspect, an antenna may be disposed on the electrically conductive structure.

In an aspect, an apparatus may include an electrically conductive wedge having two substantially planar surfaces having an included dihedral angle, and a reactive edge treatment of a self-resonant structure (SRS) disposed on at least one of the surfaces of the wedge between a radiating structure and an edge of the wedge.

In another aspect, an antenna system may include a conductive ground plane, an antenna mounted on the ground plane; and a reactive edge treatment which may be an array of capacitively-loaded loops. The loops may be oriented such that a loop normal axis is parallel to an edge of the ground plane.

A method of suppressing (enhancing) hard polarization electromagnetic diffraction from an edge includes the steps of: providing an array of electrically-small loops having a self-resonant frequency; disposing the loops along the edge of the wedge such that an axis normal to a plane of a loop of the array of loops is parallel to the edge; selecting the self-resonant frequency of the array of loops to be below (above) the frequency range where the suppression (enhancement) is desired; and, positioning the array of loops to be less than one free-space wavelength from the edge at the self-resonant frequency.

DETAILED DESCRIPTION

Reference will now be made in detail to several examples; however, it will be understood that the claimed invention is not limited to such examples. In the following description, numerous specific details are set forth in the examples in order to provide a thorough understanding of the subject matter of the claims which, however, may be practiced without some or all of these specific details. In other instances, well known process operations or structures have not been described in detail in order not to unnecessarily obscure the description.

When describing a particular example, the example may include a particular feature, structure, or characteristic, but every example may not necessarily include the particular feature, structure or characteristic. This should not be taken as a suggestion or implication that the features, structure or characteristics of two or more examples should not or could not be combined, except when such a combination is explicitly excluded. When a particular feature, structure, or characteristic is described in connection with an example, a person skilled in the art may give effect to such feature, structure or characteristic in connection with other examples, whether or not explicitly described.

Controlling diffraction at ground plane edges is useful for general antenna pattern control; for example, sidelobe level reduction and backlobe level reduction. Suppression of edge diffraction may also improve the radiation efficiency of body-worn antennas whose ground plane is placed in close proximity (fraction of a free-space wavelength) to living tissue Controlling edge diffraction may also help to isolate co-situated antennas. Often two or more antennas will be mounted on the same conductive body, for example on ships, antenna towers, or vehicles where space is limited. Even if there is no line-of-sight between antennas separated on a ground plane edge, diffraction may allow some amount of electromagnetic coupling. Similarly, cross-polarized antennas that would be minimally coupled on an infinite ground plane may couple to each other through edge diffraction on a finite ground plane, since the scattering from the ground plane edge may de-polarize the incident signal. Suppression of edge diffraction may lower mutual coupling between co-situated antennas, improving system isolation, or reducing the electromagnetic interference (EMI).

Figure 1:
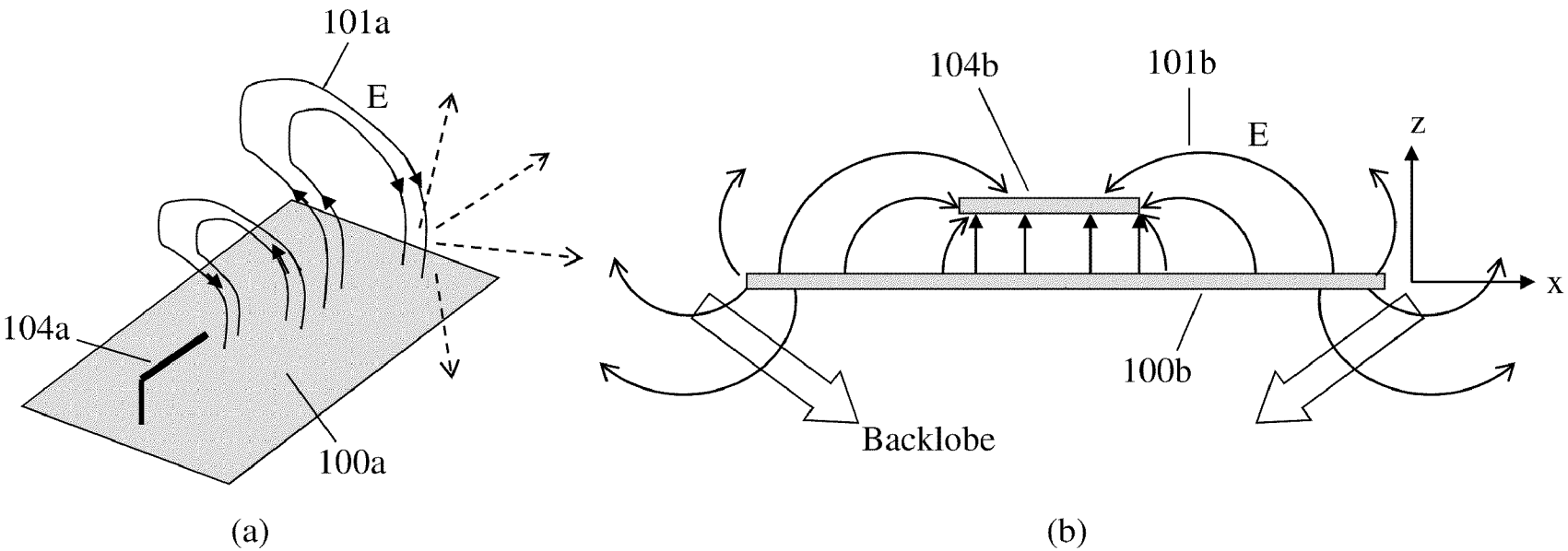
FIG. 1 PRIOR ART
FIG. 1 shows antennas launching electric fields that are diffracted at the edges of the antenna ground plane. (Prior Art)

Consider the two antennas radiating on finite ground planes as shown in FIG. 1. Wire antenna 104*a* in FIG. 1(*a*) may radiate an electric field 101*a* which becomes an incident wave at the conductive edge of a finite-dimensioned ground plane 100*a*. Diffraction of the incident field at this edge results in scattering around the edge, and thus backlobes appear in the far field below or behind the antenna ground plane. Another case is illustrated in FIG. 1(*b*) where a patch antenna 104*b* launches E fields toward the edges of a finite-dimensioned ground plane 100*b* and the fields are diffracted below the ground plane so as to appear as backlobes in the far field.

A substantially linear array of electrically-small, capacitively-loaded loops may be disposed close to the edge of the wedge. The loops may be substantially planar, and may be oriented such that their axes are essentially parallel to the edge. Hence, the plane of the loops is approximately perpendicular to the faces of the wedge. The loops are oriented so as to couple with the incident magnetic field of the TM (to the plane of incidence field) mode, also known in the literature as the of TEz (transverse electric to z) polarization, where the z axis is parallel to the edge. This polarization is also known as the "hard polarization." The loops may be in electrical contact with a face of the conductive wedge. Alternatively, the loops may not be in electrical contact with the wedge.

The edge treatment is termed a reactive edge treatment because the capacitively-loaded loops are resonant structures that store electromagnetic energy without being intentionally lossy. The array of resonant loops may have a well defined self-resonant frequency (SRF) determined by the loop dimensions, proximity to its neighboring loops, proximity to the edge, and the value of lumped constant series capacitance.

The loop SRF may be reduced further by including a lumped constant series loading inductor in the loop circuit. The hard diffraction coefficient may be enhanced over a band of frequencies whose upper frequency limit is the loop SRF. The diffraction coefficient may also be suppressed over a band of frequencies whose lower frequency limit is the loop SRF.

In an aspect, the capacitively-loaded loops may be essentially identical and uniformly spaced so as to create a one dimensional periodic structure whose periodic axis is disposed parallel to the edge of the wedge.

In another aspect, where $\lambda_o$ is the free-space wavelength at the loop SRF, the loops are spaced apart $\lambda_o/8$ or less. The loops may have physical dimensions of side length or diameter that is $\lambda_o/8$ or smaller. In sill another aspect, the distance between the edge of the wedge and the center of the loops may be less than $\lambda_o/2$. The reactive edge treatment may be electrically small and may be used for edges where the available area is limited.

A face of the conductive wedge may contain more than one linear array of capacitively-loaded loops. Arrays of loops may be disposed on one or both faces of the conductive wedge; a loop may be electrically connected to both faces of the conductive wedge.

In another aspect, the multiple arrays of loops, if periodic, may have dissimilar periods.

The included angle of the conductive wedge may be reduced to zero to yield a half-plane structure. The half-plane may serve as a design model for a conductive layer in a printed wiring board where the edge of the half-plane is an edge of a finite-dimension metal layer of the printed circuit board. The conductive loops may be surface mounted wires or thru-hole mounted wires attached to printed wiring boards. The capacitive loads may be discrete capacitors of surface mount technology or thru-hole mount technology. Alternatively, the capacitive loads may be realized with printed patches or printed coplanar inter-digital capacitors. In another alternative, the capacitive loads may be electronically variable so as to implement a tunable reactive edge treatment where the SRF, or the frequency of operation, may be rapidly adjusted.

The loops may be disposed at discrete locations but the capacitive loads may distributed along an axis that is parallel to the edge, and the capacitive loads may have the form of inter-digital capacitors or continuously overlapping traces.

One will appreciate that the term loop as used herein may include the conductor and any discrete or distributed inductive or capacitive loading, including mutual coupling between loops so as to provide a self resonant circuit (SRC). The loading may be introduced at any location in the loop that is convenient for manufacturability, and may be at one of the ends thereof that connect to a surface of the conductive wedge. Where the term loop is used, the loop element is considered to include the loading elements, and the connection of the loop to the conductive surface may be made through one or more loading elements.

The loops may have the shapes of a partial circle, a "U", a hairpin, or the like depending on the specific design, and a portion of the electromagnetic aspect of the loop may be provided by a electromagnetic image formed with respect to the conductive surface.

The descriptions herein are easier to understand as presented for the case of transmission of electromagnetic energy. However, based on the principle of electromagnetic reciprocity, the apparatus and methods described herein are equally applicable to the reception of electromagnetic energy, and the radiation pattern computed for the transmitting case may be used for the receiving case as well.

The reactive edge treatment may be built into a printed circuit board that also contains one or more printed antenna elements and used to suppress side lobe levels and back lobe levels.

Figure 2:
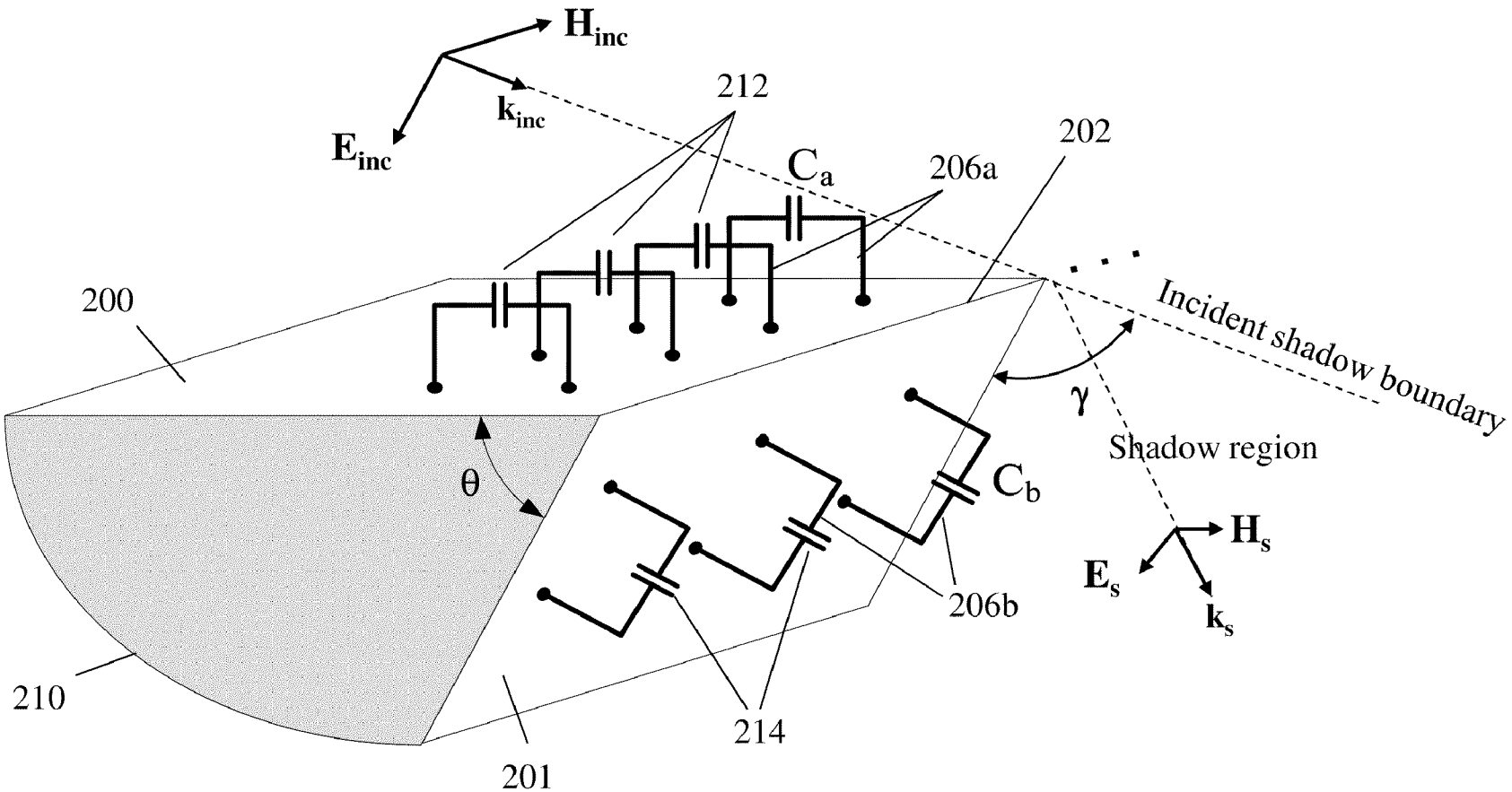
FIG. 2 shows an embodiment as it relates to a conductive wedge.

FIG. 2 illustrates a first embodiment. The electromagnetic environment is a conductive wedge 210 forming an included dihedral angle $\theta$, where $0 \leqq \theta < \pi$. Surfaces of the conductive wedge include planar faces 200 and 210 which meet at a line to form edge 202. An incident electromagnetic plane wave may illuminate the conductive wedge 210 and form a shadow region of angle $\gamma$. The polarization of the incident plane wave is such that the incident E field, $E_{inc}$, is normal to the edge 202, and the incident magnetic field, $H_{inc}$, is parallel to the edge 202. As has been mentioned, this polarization is conventionally known as the hard polarization, as opposed to a soft polarization.

An array of capacitively loaded conductive loops may be in electrical contact with the surfaces of the wedge 210. An array of loops 206*a* may be disposed essentially parallel to the edge 202, and the axes of the loops are substantially parallel to the edge 202 so as to permit coupling with the incident magnetic field $H_{inc}$. For example, the array of capacitively loaded loops 206*a* may be a periodic array of uniformly spaced loops with period P1 defining their separation distance, where all loops may have the same value of loading capacitance $C_a$. Alternatively, the array of loops 206*a* may not be identical, but the individual loop resonant frequencies may be substantially the same. For instance, the loop areas and values of loading capacitors $C_a$ may differ, but the product of self inductance times the load capacitance of each loop may be substantially the same. Where the term substantially is used, a variation of approximately plus or minus 10 percent from a nominal value would be understood.

The capacitors 212 that load the loops 206*a* are represented schematically in FIG. 2. Physically, the capacitors may be disposed at different locations on a loop, or at multiple locations on a loop. Additional rows of capacitively-loaded loops may be present on the conductive wedge 210, such as the array of loops 206*b* electrically connected to face 201. The array of loops 206*b* is oriented such that the normal axis thereof is substantially parallel to the edge 202. For example, the array of capacitively-loaded loops 206*b* may be a periodic array of uniformly spaced loops with period P2 defining a separation distance along the edge where all loops have substantially the same value of loading capacitance $C_b$. Alternatively, the array of loops 206*b* may not be identical, or even uniformly spaced, but the individual loop resonant frequencies may be substantially the same.

FIG. 2 illustrates an embodiment where a linear array of loaded loops is disposed on both faces 200 and 201. Only one linear array of loops may be employed. Alternatively, both linear arrays of loops 206*a* and 206*b* may be disposed on either face 200 or 201. In yet another alternative, the linear arrays of loops 206*a* and 206*b* may both be periodic, yet have different periods. In still another aspect, the arrays of loops 206*a* and 206*b* may be disposed at different distances from the edge 202.

The loops are electrically small. That is, the largest loop dimension may be of the order of $\lambda_o/8$ or smaller where $\lambda_o$ is the free space wavelength at the loop SRF. Also, the distance between adjacent loops may also be of the order of $\lambda_o/8$ or smaller. In another aspect, the linear arrays of loops may be positioned within $\lambda_o/2$ distance from the edge 202.

Figure 3:
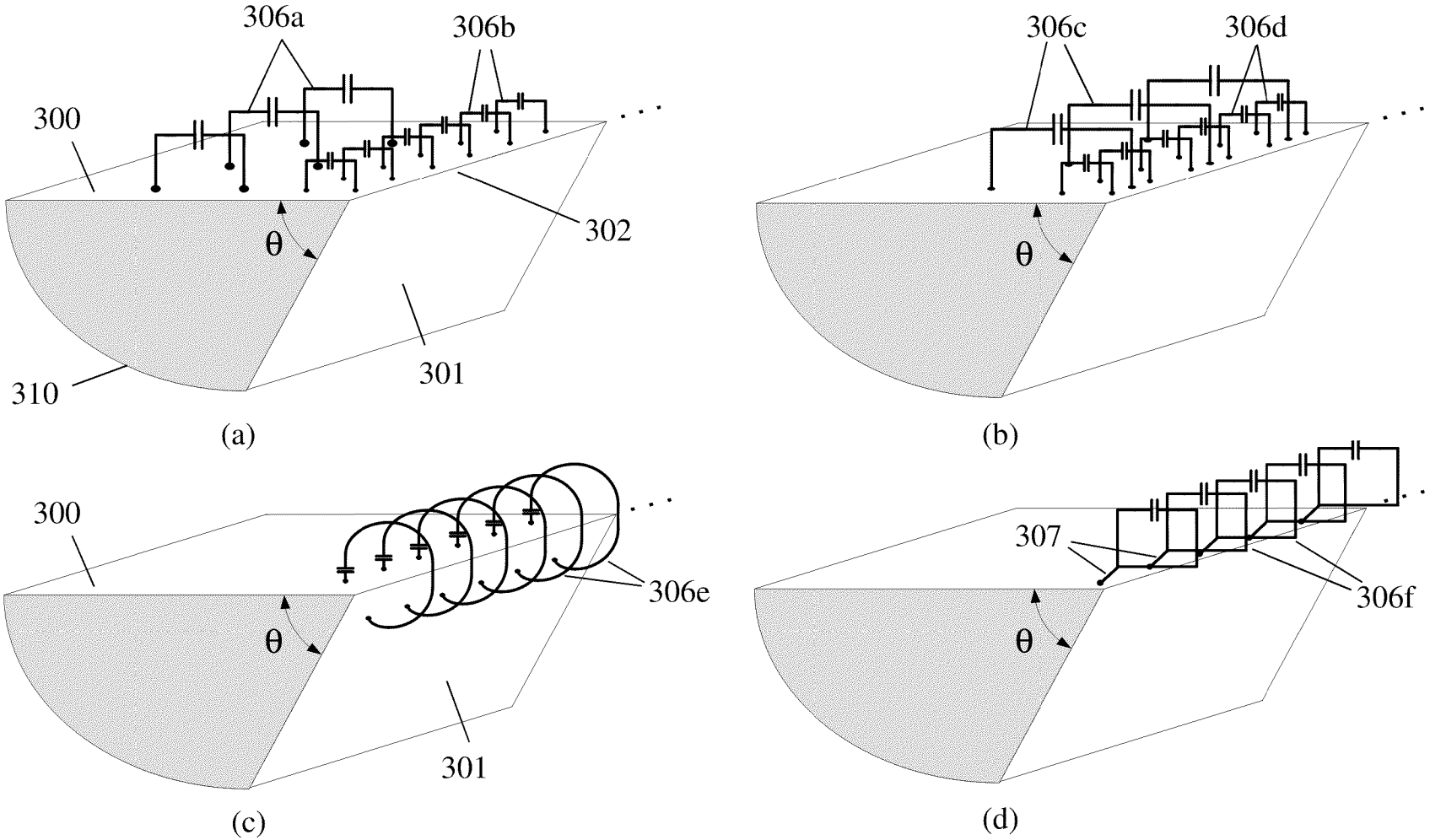
FIG. 3 shows four embodiments as they relate to a conductive wedge.

FIG. 3(*a*) shows an embodiment having multiple rows of capacitively-loaded loops on face 300 or 301 of the conductive wedge 310. Each row of loops may be tuned so that a self-resonant frequency (SRF) may be a unique frequency. This configuration may provide a multi-band response for suppression of the diffraction coefficient. In an example, the row of loops closest to the edge may have the highest SRF. (See curve 1315 of FIG. 13). In another example, the row of loops farthest from the edge may have the highest SRF. (See curve 1321 of FIG. 13).

In another aspect, the row of loops farthest from the edge has the largest loop area, a wider spacing between loops, and a lower SRF.

FIG. 3(*b*) shows an embodiment where loops 306*c* and 306*d*, of different sizes, are nested such that the volume occupied by the smaller loops is essentially enclosed by the volume occupied by the larger loops.

FIG. 3(*c*) shows an embodiment where capacitively-loaded loops are disposed at the edge such that each end of a conductive loop 306*e* is electrically connected to an opposite face of the wedge.

FIG. 3(*d*) shows an embodiment where the capacitively-loaded loops are disposed away from either face of the wedge, and each loop is electrically connected by wires 307 to a face of the wedge. In another embodiment, the electrical connections 307 are absent and that the loops may be electrically isolated from the conductive wedge.

The operation of the capacitively-loaded loops is such that, for frequencies below their self-resonant frequency (SRF), the loops effectively increase the magnetic permeability of the region occupied by the array of loops. Such enhancement of permeability occurs over a range of frequencies below the SRF of the loop array, and may enhance the hard diffraction coefficient associated with the edge 202. Thus, scattered electromagnetic fields in the shadow region may be increased in magnitude relative the case of the same wedge 210 without the reactive edge treatment of the loop array.

Conversely, for frequencies above the SRF of the loop array, the effective permeability of the region occupied by the loops decreases below unity and may become negative. This decrease in permeability may occur over a broader bandwidth than the enhancement described above, and it may suppress the hard diffraction coefficient associated with the edge. Thus, for frequencies higher that the SRF, the scattered electromagnetic fields $E_s$ and $H_s$ in the shadow region may be decreased in magnitude relative the case of the same wedge 210 without the reactive edge treatment of the loop array.

Thus, by positioning the SRF of a reactive edge treatment above or below the operating frequency of an antenna, the scattering of electromagnetic energy from an edge of a finite dimensioned structure may be increased or decreased, respectively.

Figure 4:
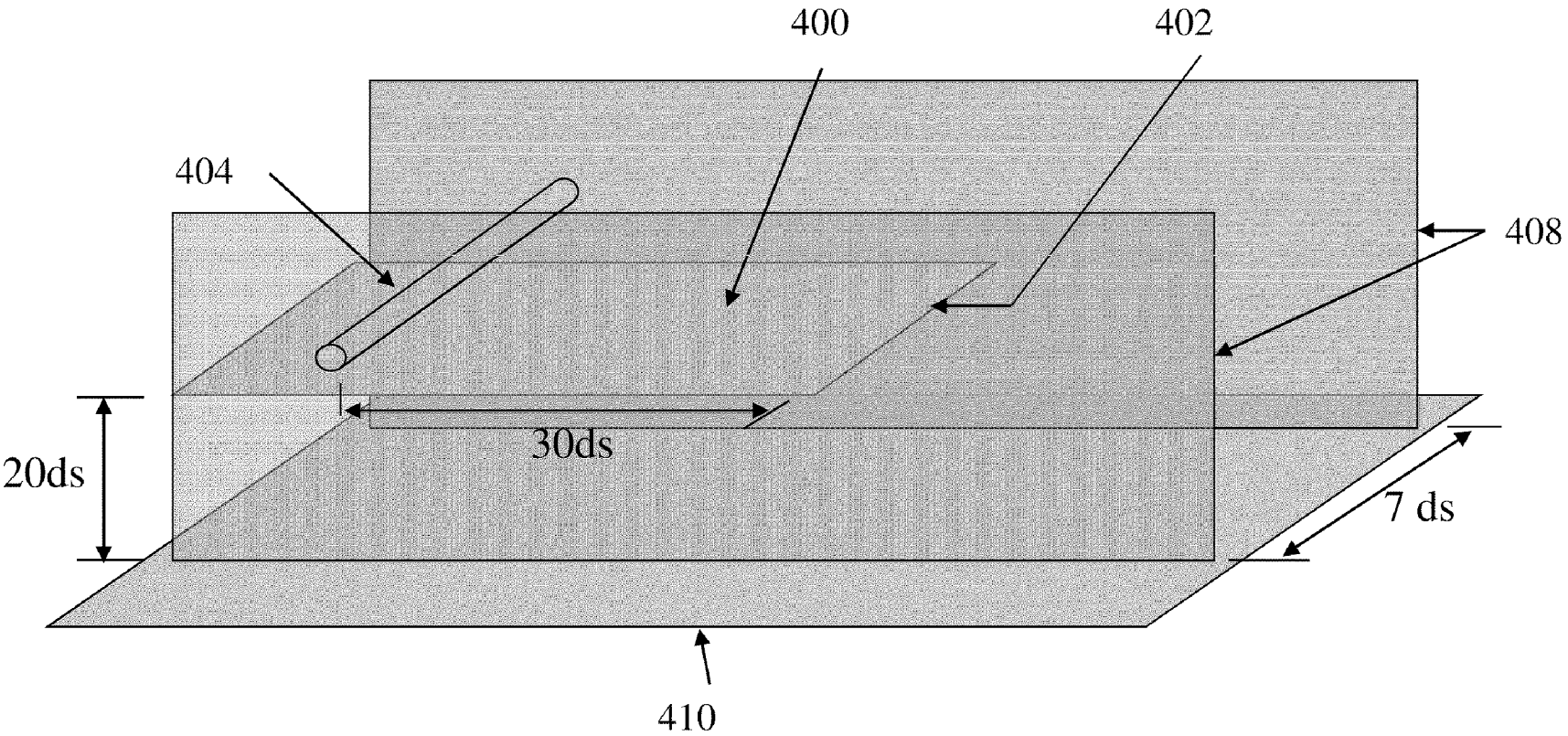
FIG. 4 shows an FDTD workspace used for simulation.
Figure 5A:
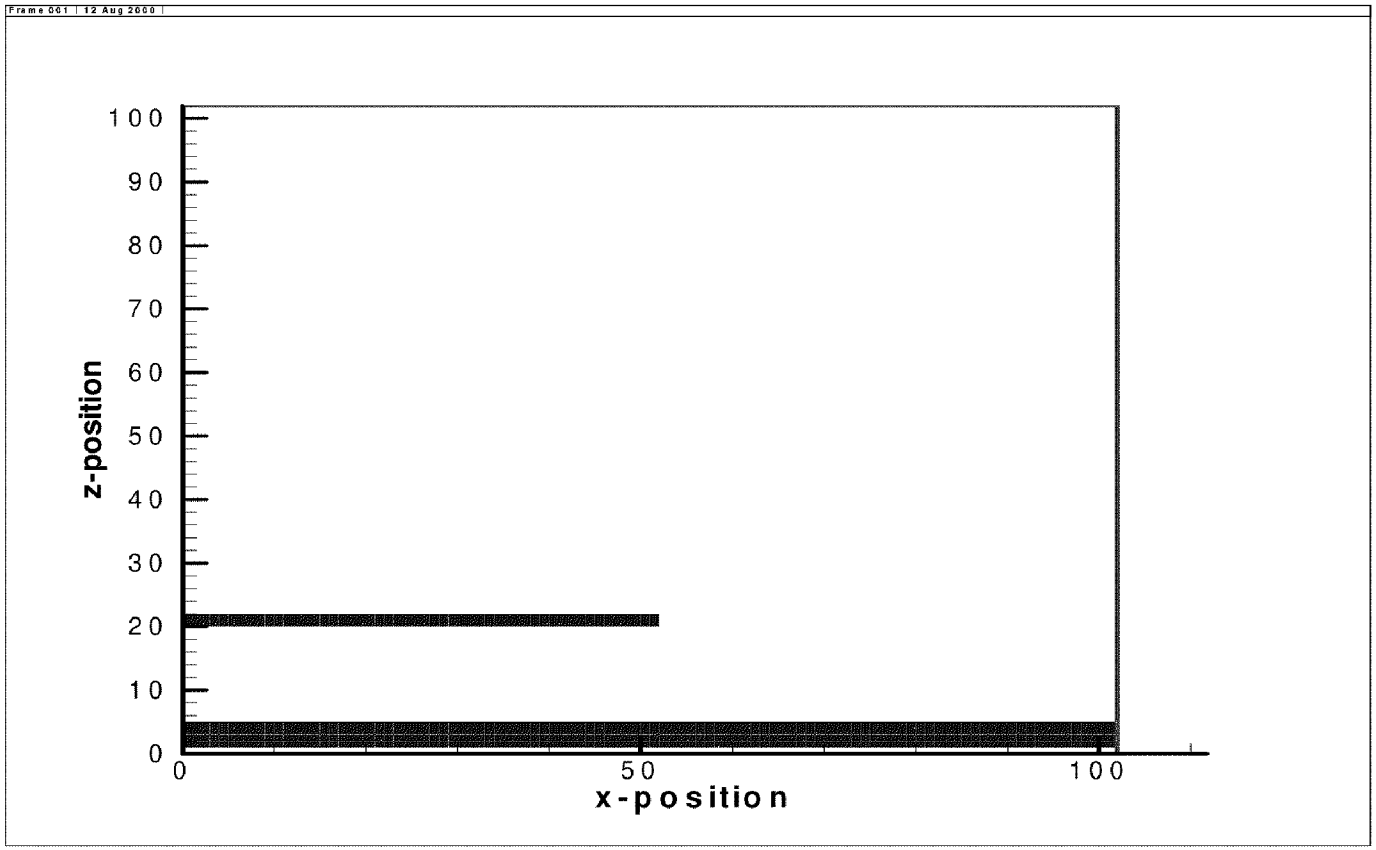
FIG. 5 illustrates an embodiment modeled in an FDTD workspace and the resulting power density performance.
Figure 5B:
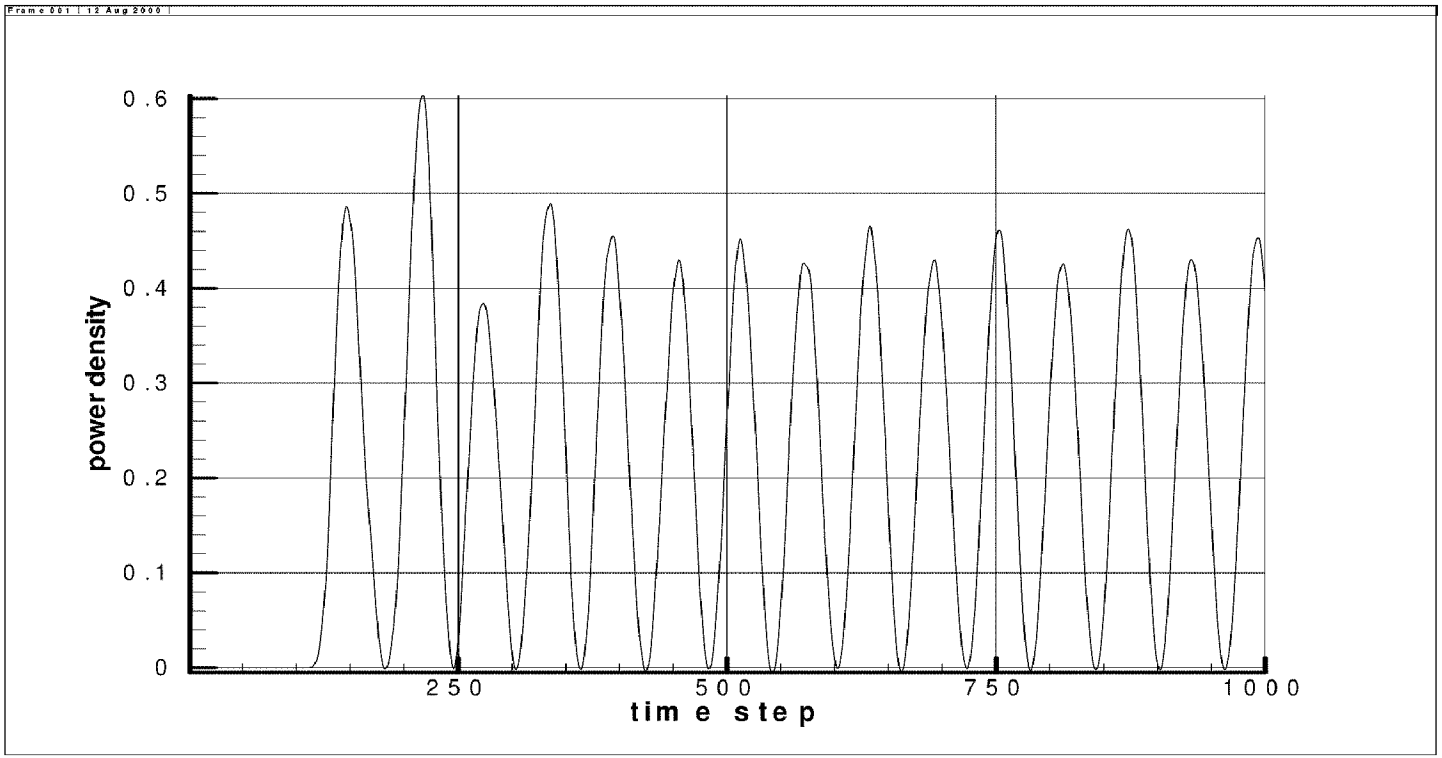
Figure 5C:
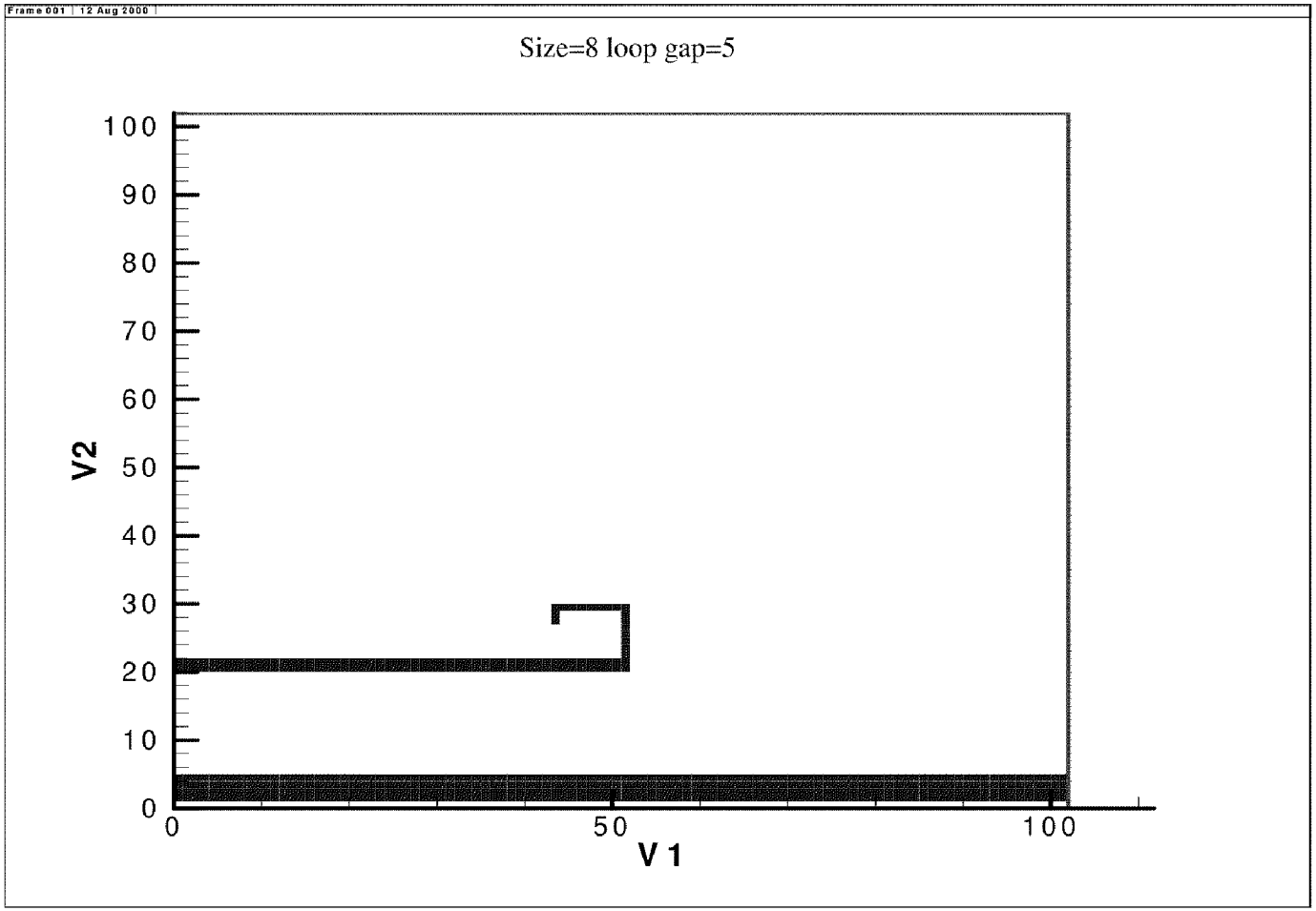
Figure 5D:
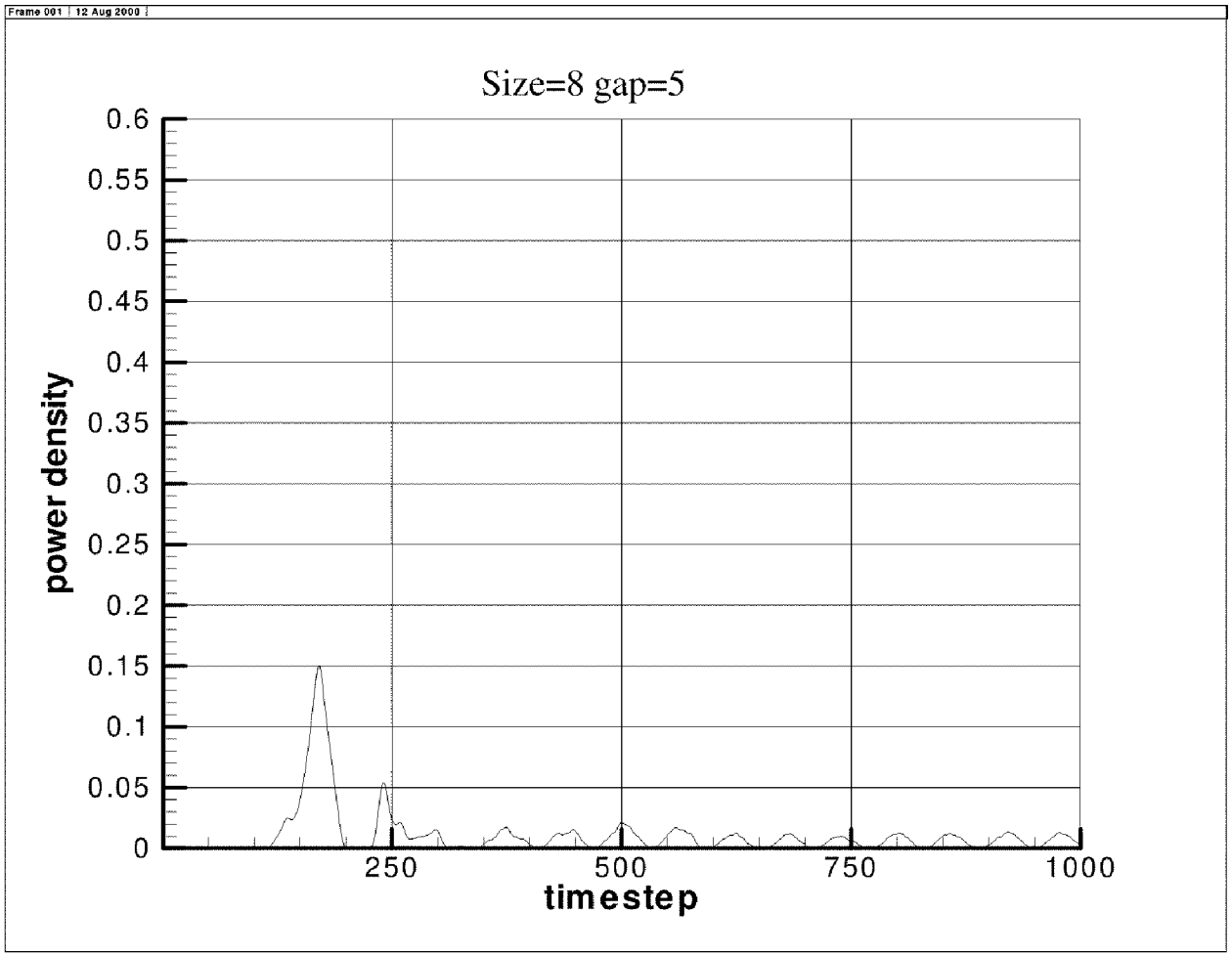

The electromagnetic performance of the structures may be understood by numerical simulation using a finite difference time domain (FDTD) algorithm. FIG. 4 illustrates the features of a FDTD workspace used to simulate a canonical case of a knife edge, a half plane, where θ=0. A magnetic line source 404 excites the workspace from a position above a finite-dimensioned ground plane 400. Perfect magnetic conductors (PMCs) 408 terminate the front and back sides of the workspace so as to simulate an infinite periodic structure along the axis of the magnetic line source. A large ground plane 410, which is an electric conductor, terminates the bottom side. Absorbing boundary conditions (ABCs) terminate the left, right, and top sides of the workspace. The workspace is meshed with cubic cells of arbitrary dimension ds.

FIG. 5(*a*) shows the geometry for the baseline workspace where no reactive edge treatment is present. FIG. 5(*b*) shows a plot of power density $E_z \times H_y$ flowing to the left at an observation point behind the finite-dimensioned ground plane. FIG. 5(*c*) shows the same workspace with a capacitive loop placed at the conductive edge 402. The loop has dimension 8 ds by 8 ds with a 5 ds gap on the left side thereof to form a small capacitor. With the same excitation and observation point, the resulting power density is plotted in FIG. 5(*d*). The source frequency is selected such that its period is 240 dt where dt is a time step. FIG. 5(*d*) shows a reduction in power density of at least 10 times for the TEM mode in the parallel-plate waveguide (PPW) formed by the finite-dimensioned ground plane 400 and the ground plane at the bottom of the workspace. Since this PPW power is proportional to the square of the hard diffraction coefficient of the edge, the diffraction coefficient is reduced for this source frequency.

Figure 6A:
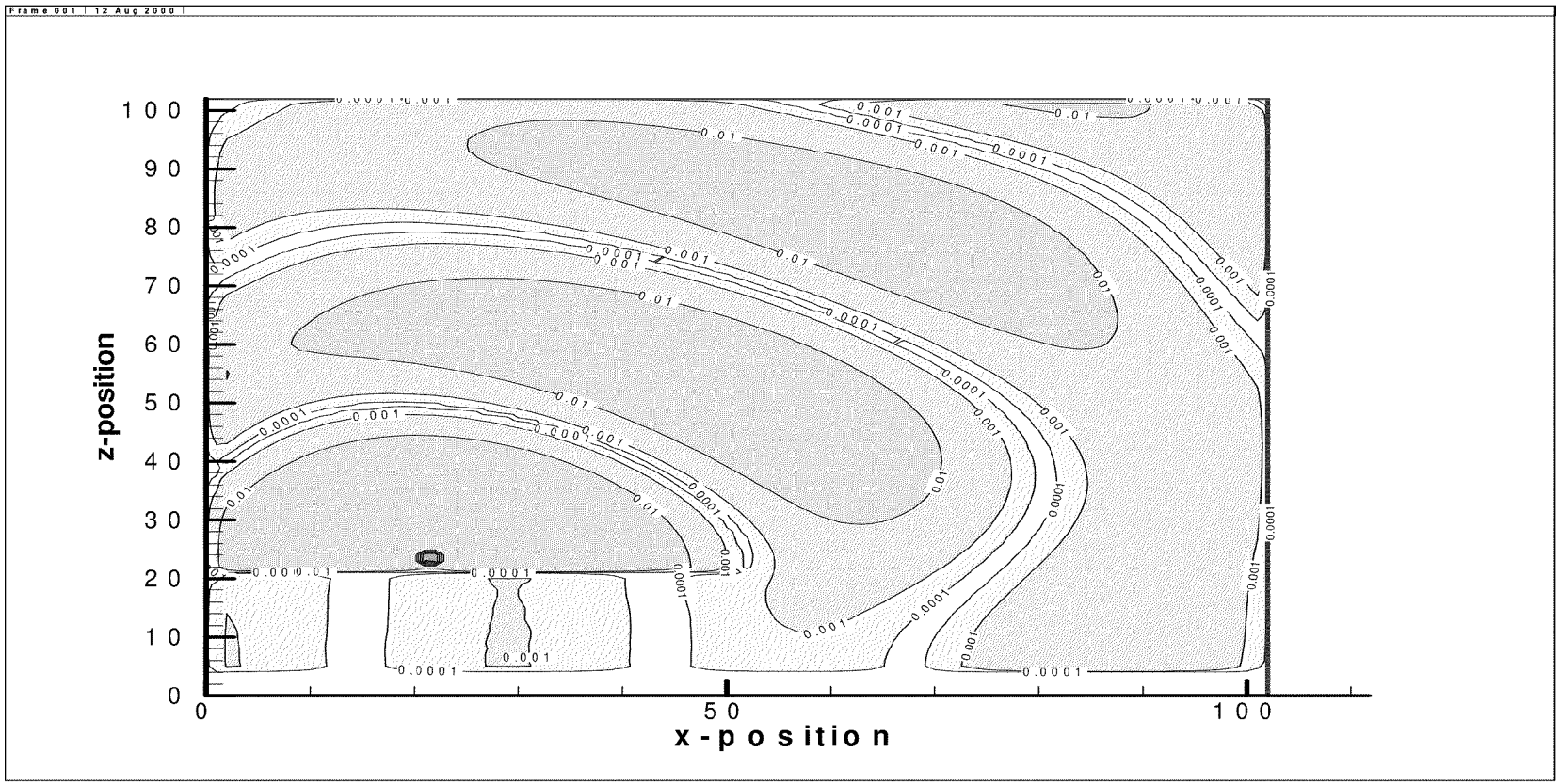
FIG. 6 shows two FDTD E-field contour plots.
Figure 6B:
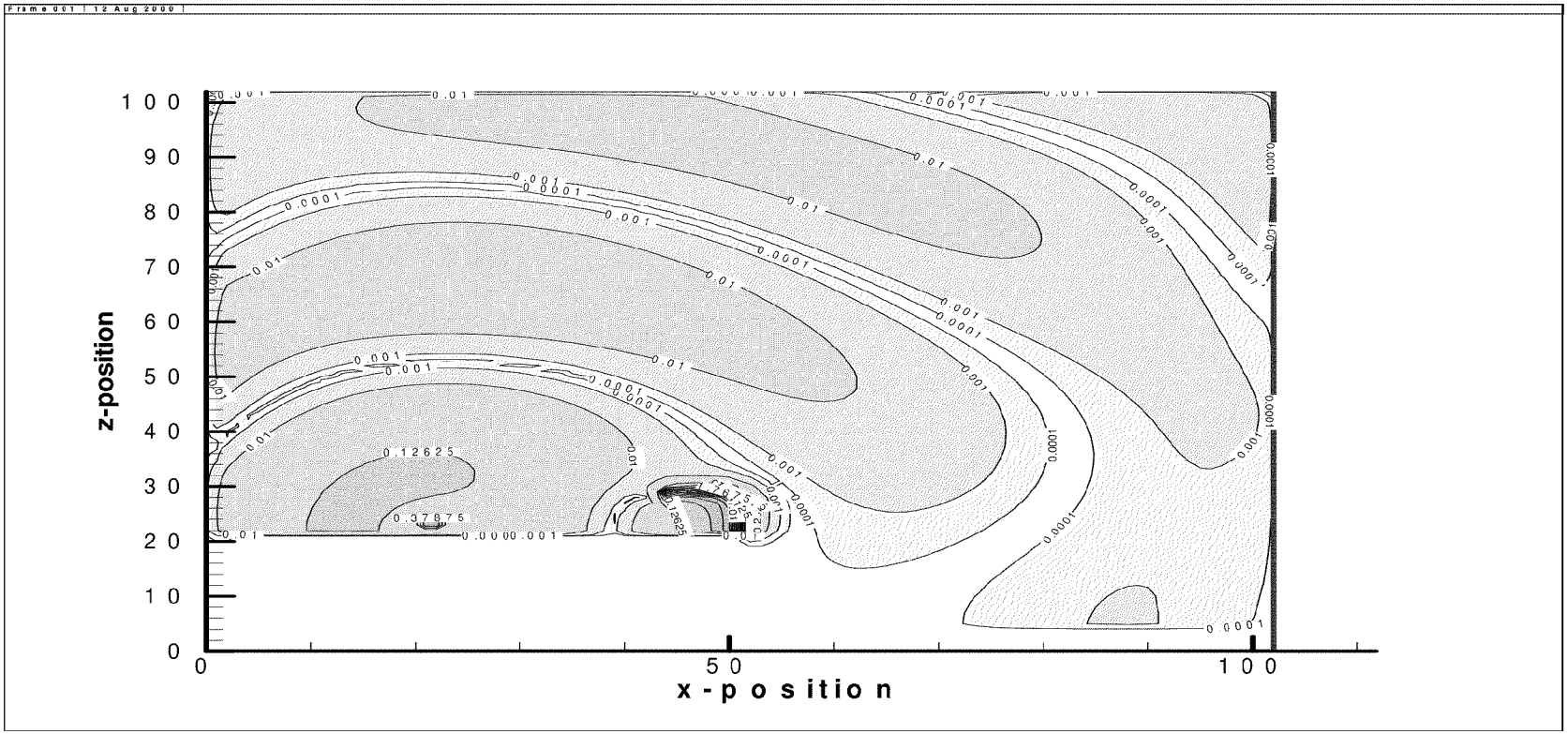

FIG. 6 shows two contour plots of the near electric field at time step 1000 dt, with and without the loop reactive edge treatment. FIG. 6(*a*) shows the case with no loop where contours of E field appear below the finite ground plane. FIG. 6(*b*) shows the contour plot for the case where the loop of FIG. 5(*c*) is disposed in the workspace. There are no contours apparent below the finite ground plane of FIG. 5(*b*) with this display scale, illustrating that an array of capacitively loaded loops may suppress diffracted waves from an edge.

Figure 7:
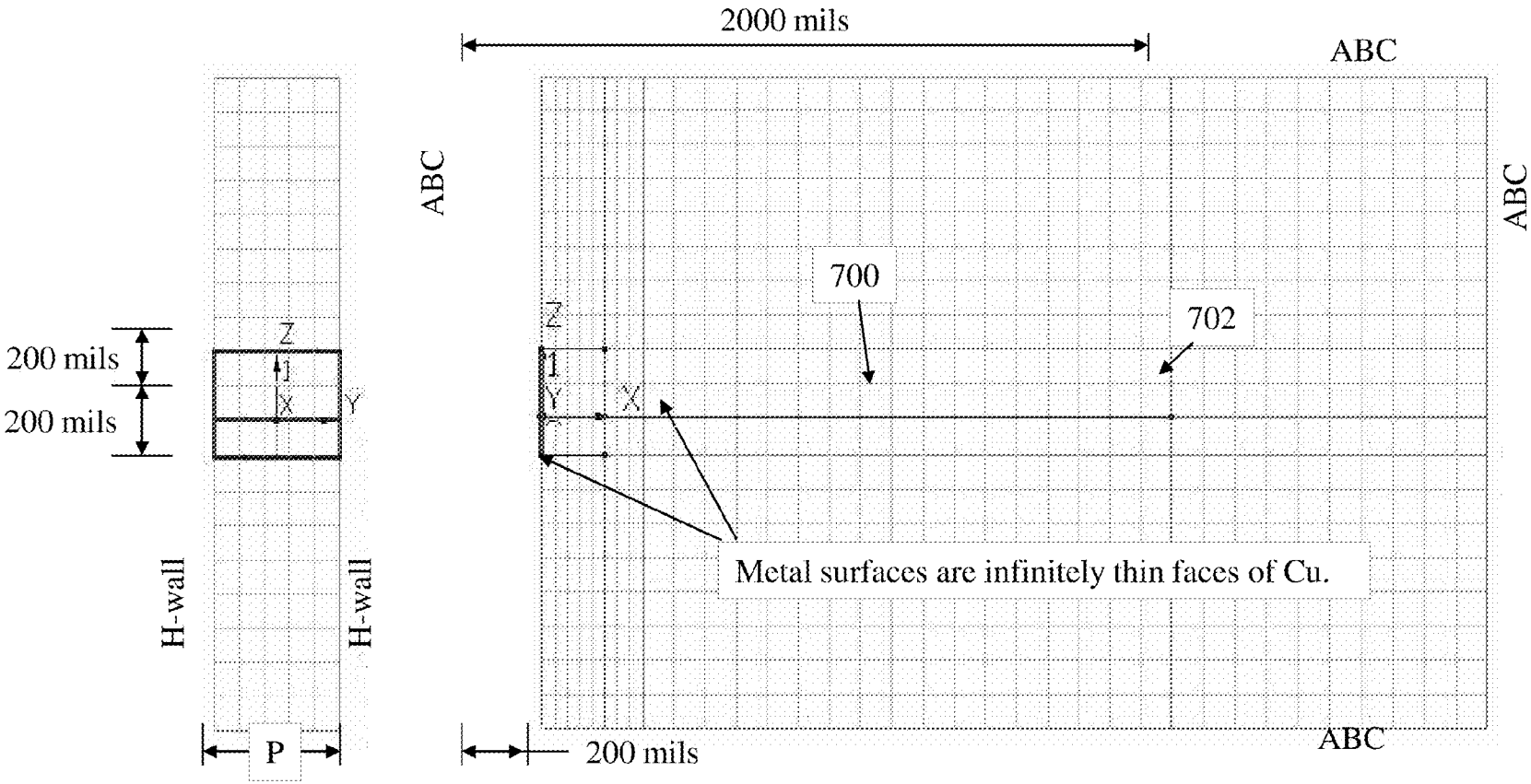
FIG. 7 shows the workspace used for TLM simulations of some embodiments.

Another set of numerical simulations was performed using a transmission line matrix (TLM) method code known as Microstripes™ version 7.1 (available from Flomerics, Southborough, Mass.). The workspace used in these simulations is shown in FIG. 7. The boundary conditions are ABCs for $x_{min}$=0 and $x_{max}$=3000 mils, $z_{min}$=−1000 mils and $z_{max}$=1000 mils, plus magnetic walls for $y_{min}$=−P/2 and $y_{max}$=P/2. A finite ground plane 700 models a wedge angle of θ=0 with an edge 702 located 2000 mils from the ports. Two identical TEM mode ports of height 200 mils are placed at $x_{min}$ and used for two port coupling measurements. The ports are polarized with an E field in the z direction, and short metal flanges of 200 mil length form PPWs that launch and receive the vertically polarized waves. This workspace models one unit cell of an infinite structure in the y direction. This model was simulated without any loaded loops to obtain a baseline coupling level which is independent of the y dimension P of the workspace.

Figure 8:
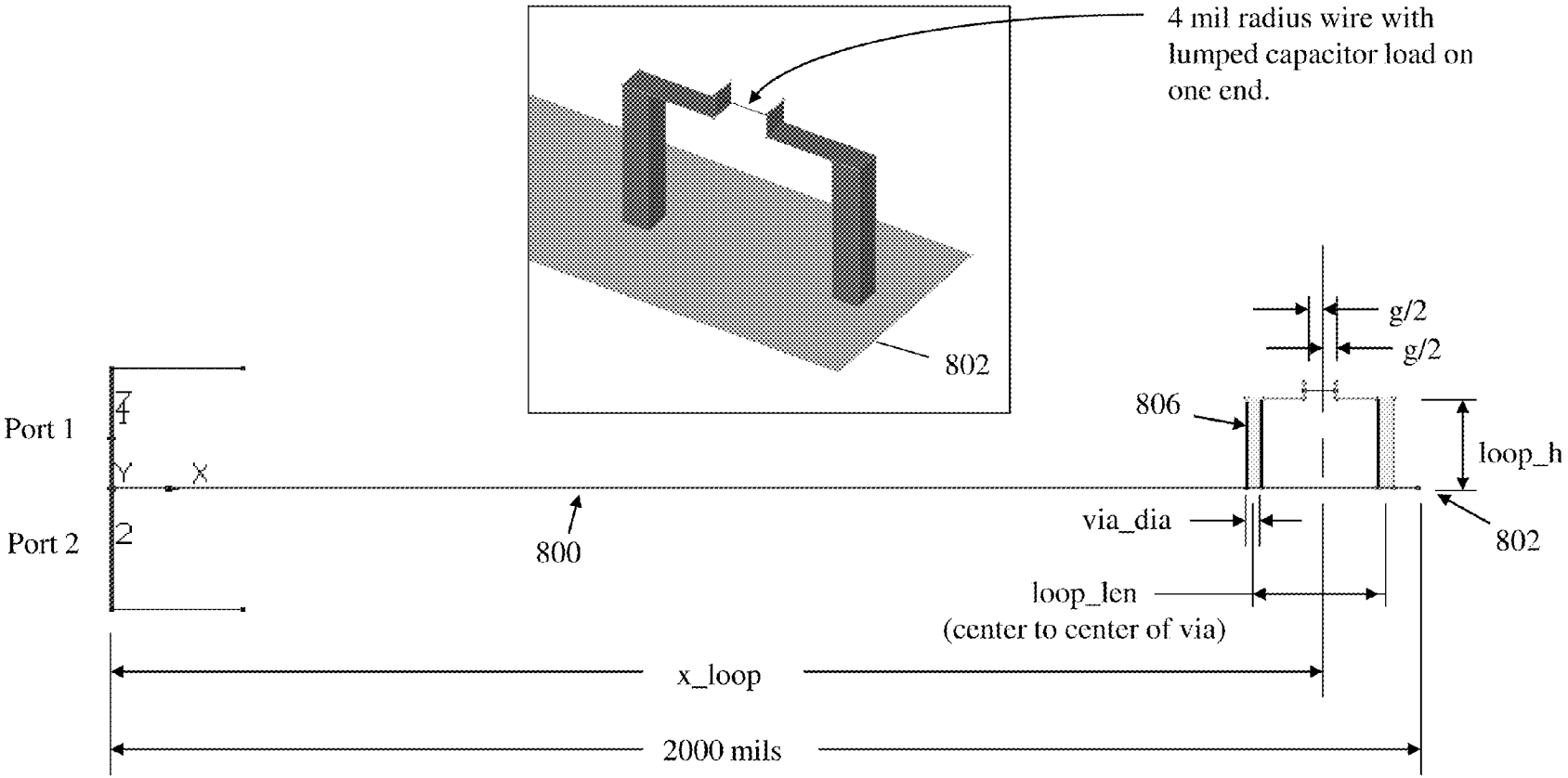
FIG. 8 shows the simulation variables associated with the TLM model of a capacitively-loaded loop in one unit cell as a periodic array.

FIG. 8 illustrates a profile view of the conducting bodies in the workspace of FIG. 7. The finite ground plane 800 is 2000 mils in total length. Ports are located at x=0 above and below the ground plane. Power may be coupled between the ports by virtue of electromagnetic diffraction around the edge 802. A single capacitively-loaded loop 806 is disposed near the edge located a center line distance x_loop from the ports. The loop height and length is 150 mils and 200 mils respectively. A 50 mil gap is modeled in the top of the loop, across which is placed a 4 mil perfectly conducting wire. The wire has a lumped series capacitance with a nominal value 0.15 pF. The sides of the loop are formed by posts or vias of 25 mils diameter. The base portions of the vias are in contact with the finite ground plane 800. These are the nominal parameters for the following TLM simulations, unless otherwise noted.

Figure 9:
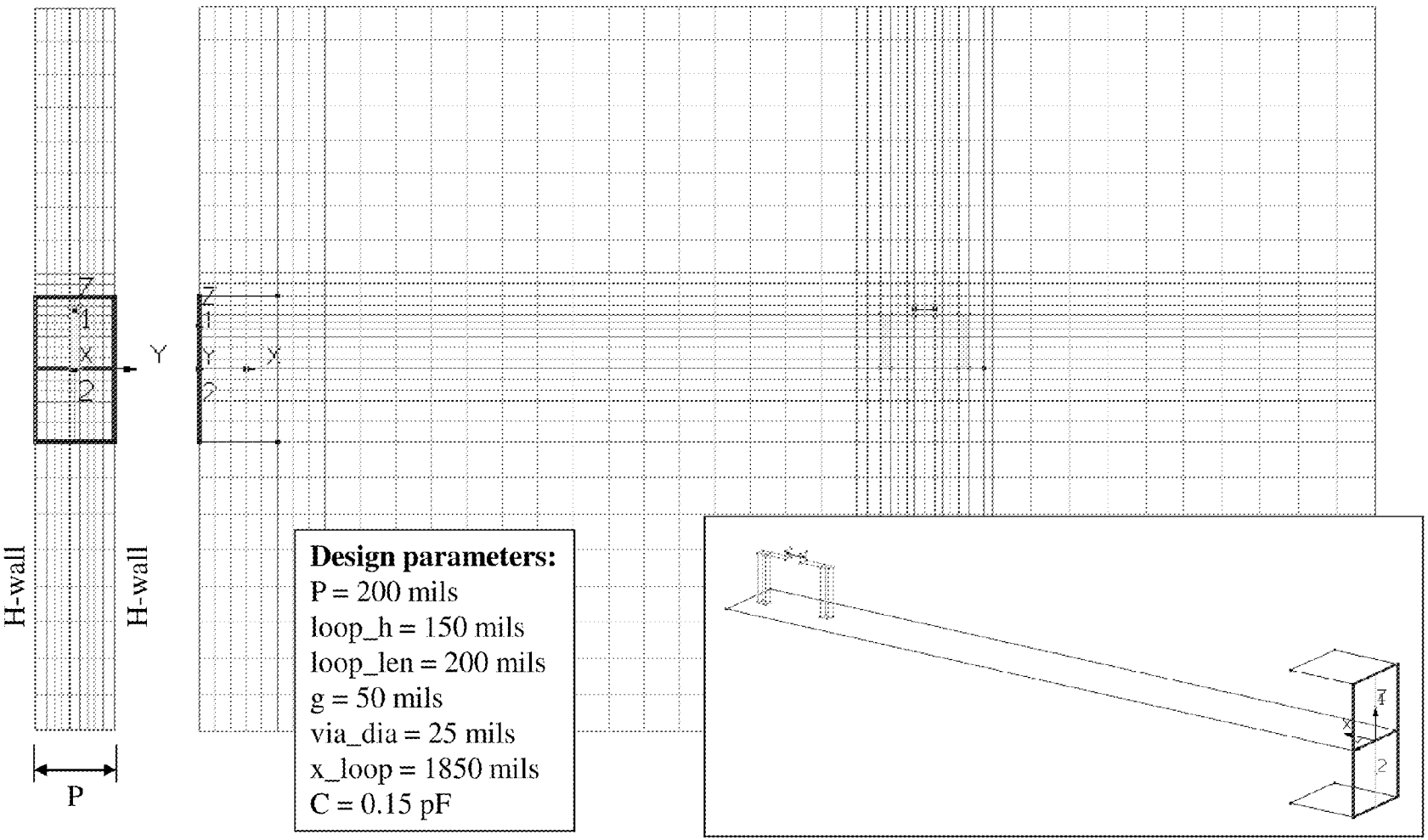
FIG. 9 shows the TLM workspace used to simulate one embodiment.

FIG. 9 shows the meshed TLM workspace used to simulate the embodiment of shown in FIG. 8. Nominal parameters are also listed.

Figure 10:
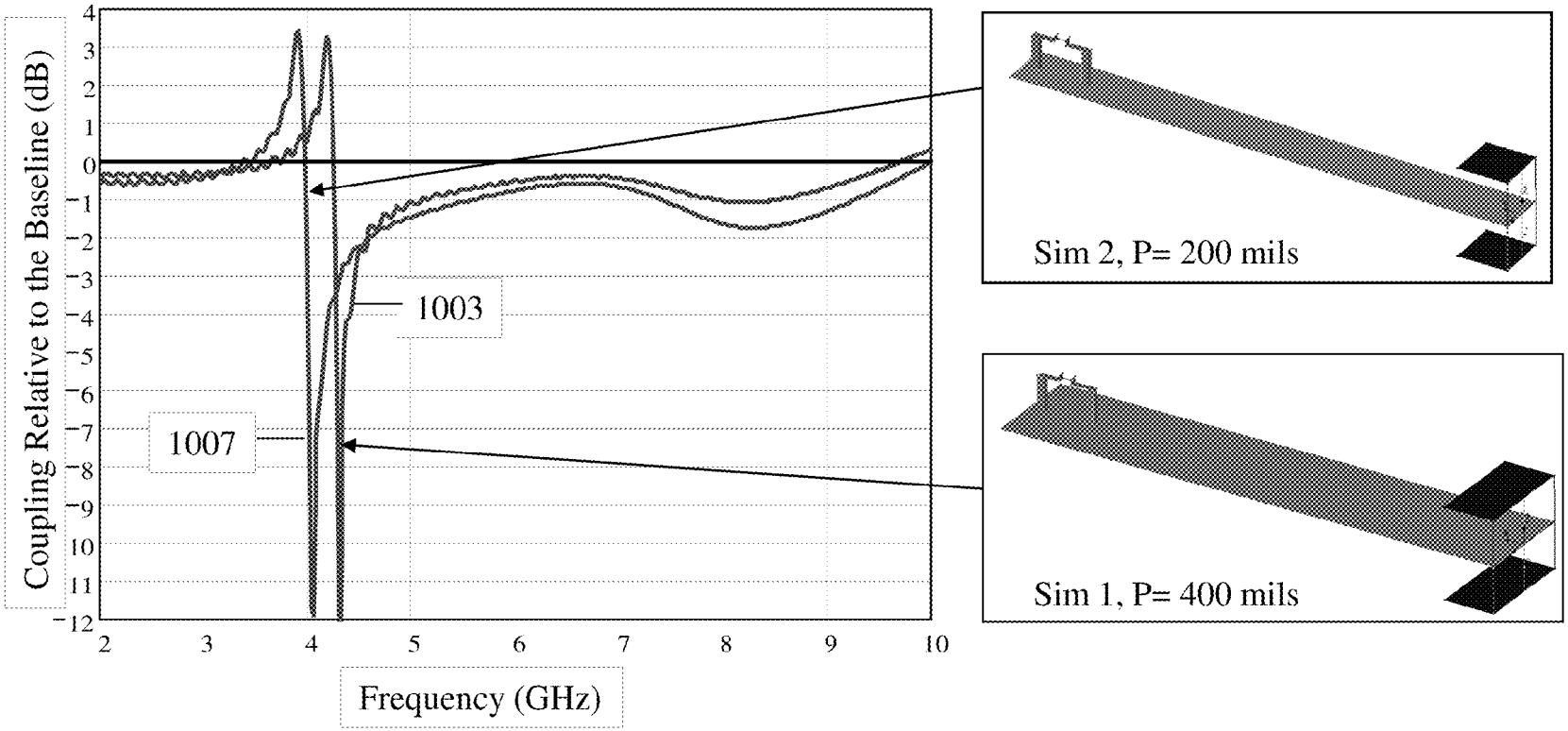
FIG. 10 shows a comparison of the coupling performance achieved when using two different periods.

FIG. 10 shows a comparison of port-to-port coupling levels for simulations with different periods P. Curve 1007 is a case where the period P is 200 mils as defined in FIG. 9. Curve 1003 is a case where the period P along the edge is increased to 400 mils. The heavy 0 dB line is the coupling value in dB relative to the baseline case where no reactive edge treatment is present (e.g., no loops). The baseline coupling is frequency dependent, but the absolute value thereof is not relevant for this comparison, and the data are more effectively shown in normalized form. Curve 1007 shows that the array of capacitively-loaded loops has a SRF of approximately 4 GHz where the coupling crosses zero dB and drops dramatically Immediately below 4 GHz, one observes enhanced coupling over a bandwidth of about 12%. Above the SRF there exists a suppression band as deep as 10 dB over 1% to 2% bandwidth. Simulation show that a smaller period may result in a broader suppression bandwidth and a slightly lower SRF. The 150 mil by 200 mil loops have an area of $\lambda_o/20$ by $\lambda_o/15$ at the SRF of the loop array. The period associated with curves 1003 and 1007 is about $\lambda_o/7.4$ and $\lambda_o/15$ respectively. Hence, the loops in this embodiment may be electrically small and may be located in the electromagnetic near field of an adjacent loop.

Figure 11:
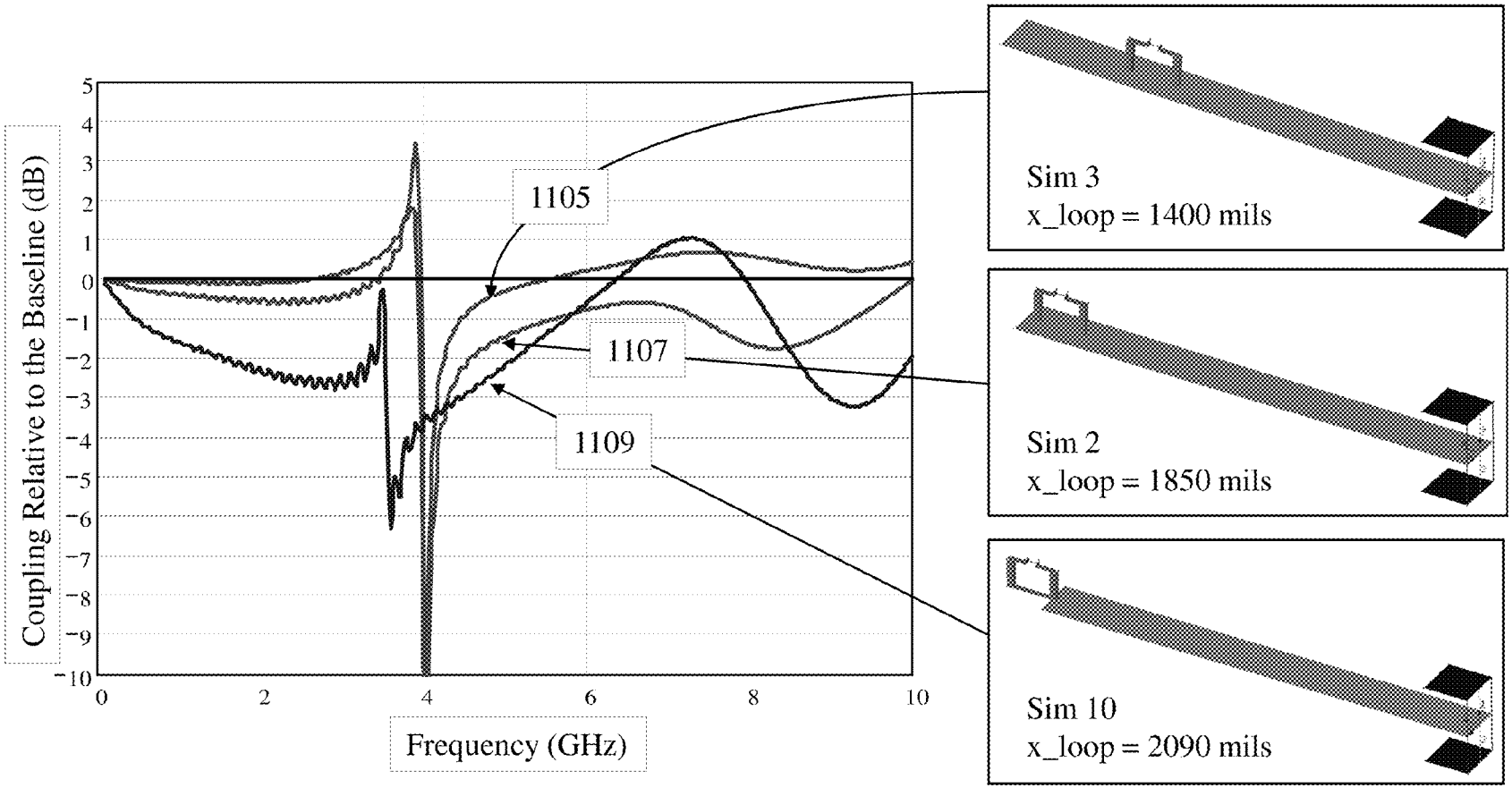
FIG. 11 shows a comparison of the coupling performance achieved when using three positions of the loop with respect to the edge.

FIG. 11 illustrates the coupling comparison for arrays of loops where the loop position varies with respect to the edge. Coupling curves 1105, 1107, and 1109 correspond to x_loop values of 1400, 1850, and 2090 mils respectively. Curve 1109 is a situation where the center of the loop is beyond the edge, but the bottom corner of the loop still touches the conductive edge of the ground plane. Moving the loop position away from the edge and toward the source appears to reduce the effective bandwidth for coupling suppression. Conversely, moving the loop center line out beyond the knife edge appears to broaden the suppression bandwidth and may also lower the SRF of the loop array as the inductance of the loop increases.

Figure 12:
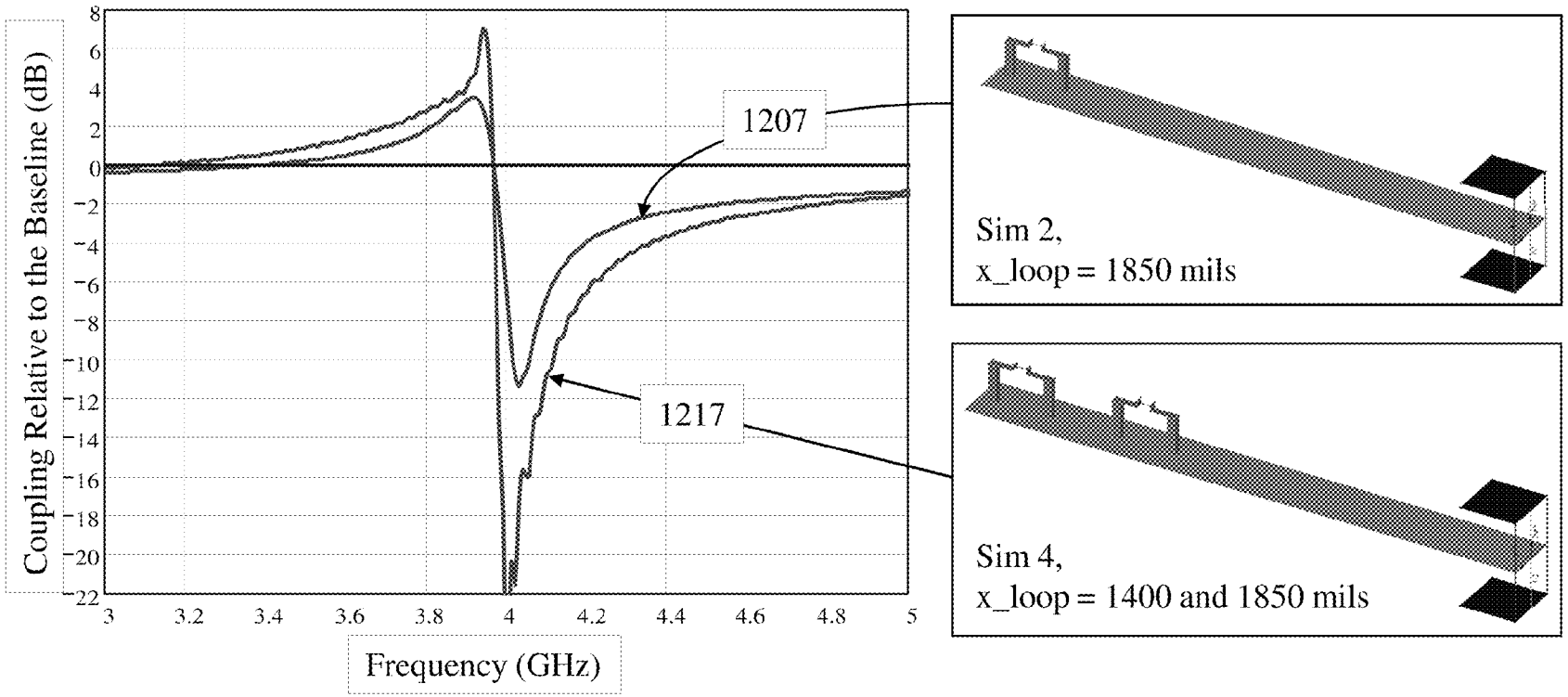
FIG. 12 shows a comparison of the coupling performance achieved when using one loop versus two loops per unit cell.

In FIG. 11, the loop position is moved forward in the x direction as to no longer be in electrical contact with the finite ground plane. The suppression bandwidth becomes narrower and the enhancement bandwidth substantially disappears. FIG. 12 shows the effect of adding a second linear array of identical loops next to the first array of loops. Curve 1207 represents the single loop per unit cell nominal case where the model parameters are listed in FIG. 9. Curve 1217 represents the case where a second identical loop is added to the unit cell at x_loop=1400 mils, y=0. The SRF where the coupling curves cross zero dB may be unchanged. However, the addition of the second loop broadens the suppression bandwidth found above the SRF, and also broadens and increases the enhancement bandwidth found below the SRF. Adding more capacitively loaded loops on the bottom side of the ground plane may also increase the bandwidth of the suppression/enhancement bands.

Figure 13:
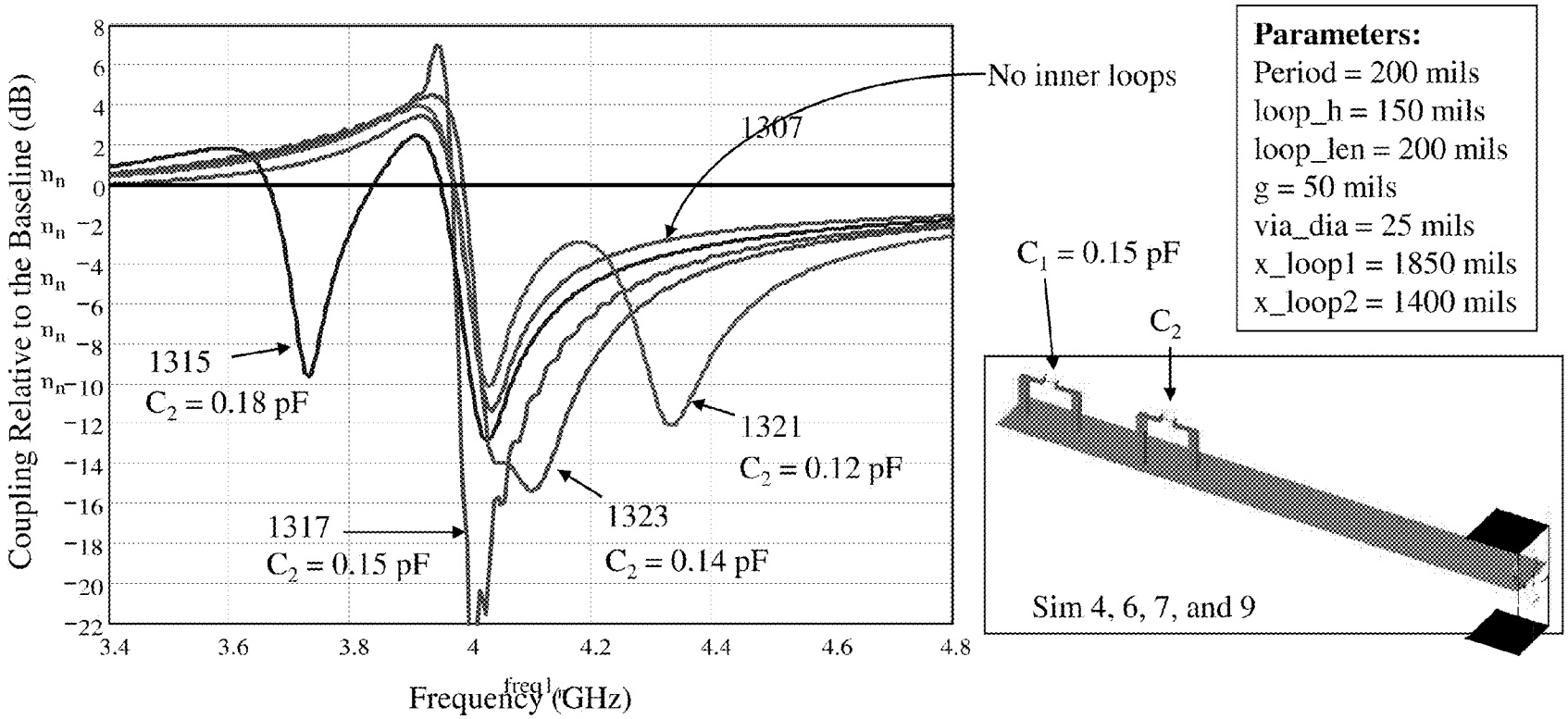
FIG. 13 shows a comparison of the coupling performance achieved when using two loops per unit cell and the second load capacitance varies parametrically.

FIG. 13 shows the effect of non-uniform capacitive loads on two identical loops within a unit cell. The physical dimensions are the same as used in FIG. 12. A capacitor of value $C_1$=0.15 pF loads the outermost loop next to the edge in each unit cell. A capacitor of value $C_2$ loads the inner loop located closer to the ports. Coupling curve 1317 is identical to 1217 (from FIG. 12) where $C_2$=$C_1$=0.15 pF. Coupling curve 1315 shows the result of increasing capacitance $C_2$. This creates a second suppression band, but the frequency range of the second suppression band is moved lower than that of the original response. This results in two relatively narrow suppression bands, which may be independently adjusted. Coupling curve 1321 shows the result of decreasing capacitance $C_2$. This decrease of capacitance also creates a second narrow suppression band, but the frequency range of the second suppression band is moved higher than the original response. For reference, Curve 1307 is the simulated coupling response where only the outer loop array with capacitive load $C_1$ is present. Curve 1319 illustrates the increasing the suppression bandwidth by selecting $C_2$ to be somewhat (~7%) less than $C_1$.

Figure 14:
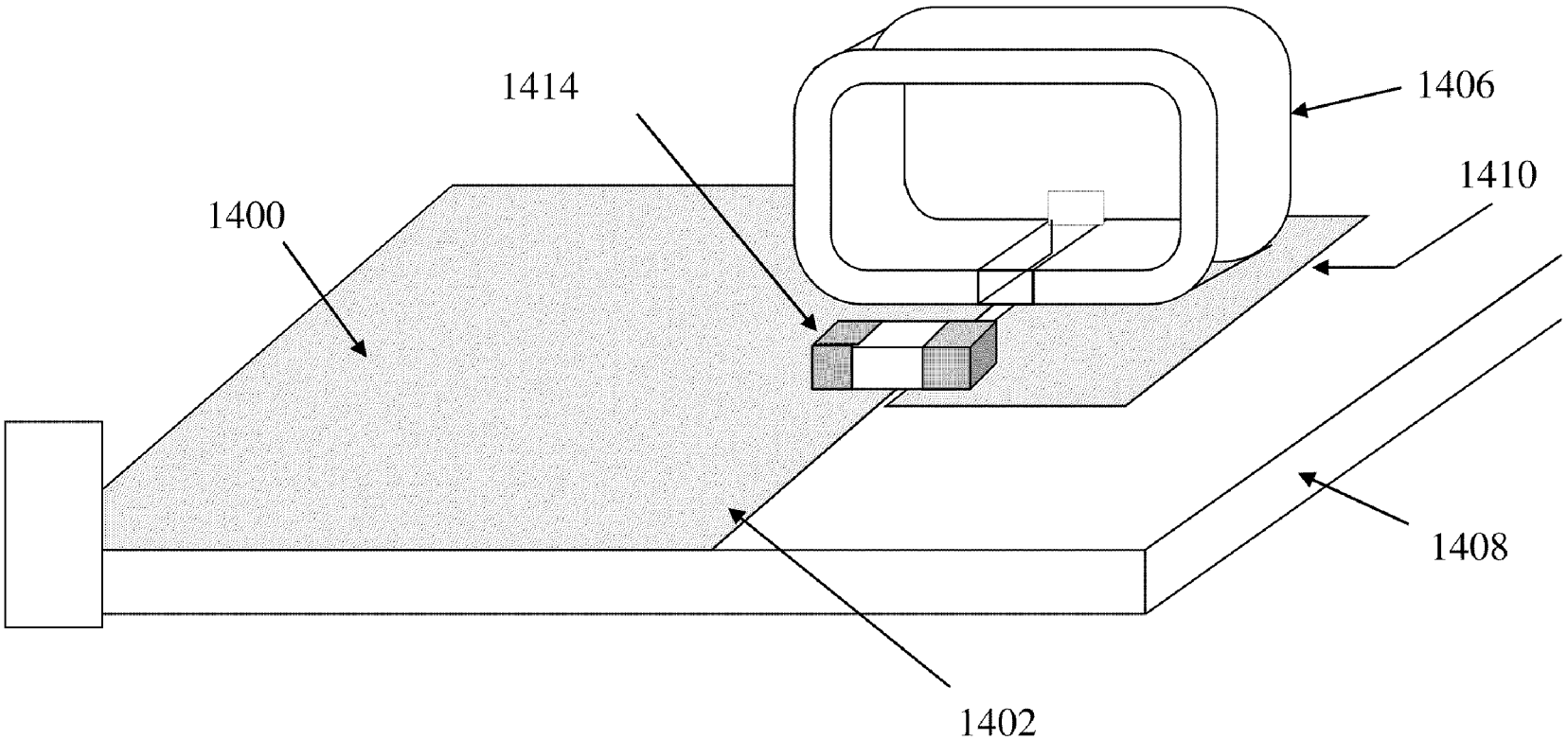
FIG. 14 shows features of one unit cell found in a printed circuit embodiment.

The loading capacitance for the loops may be provided by a capacitor that achieves the desired SRF. For instance, FIG. 14 illustrates one loop of an array of capacitively-loaded loops in which the loop is a surface mount technology (SMT) conductor 1406 on a printed circuit board 1408, and the load capacitor may be a discrete capacitor 1414 such as conventional ceramic SMT chip capacitor. The loop is shown as centered on the edge 1402, but the position of the loop may be translated toward or away from the ground plane 1400 as appropriate for greater suppression or bandwidth.

FIG. 13 showed the simulated effect of changing one of the capacitance values in a unit cell. The loading capacitance 212 or 214 (see FIG. 2) may be realized using variable capacitors such as semiconductor varactor diodes, ferroelectric or paraelectric thin film variable capacitors, MEMS (microelectro mechanical systems), analog varactors, switched capacitors including MEMS devices, or any other electrically controllable device exhibiting a variable capacitance. In addition, the loop SRF may be tuned by adjusting the loop inductance. This may be achieved using switched lumped inductors placed in series with the loop, or other arrangement having a similar effect.

Figure 15:
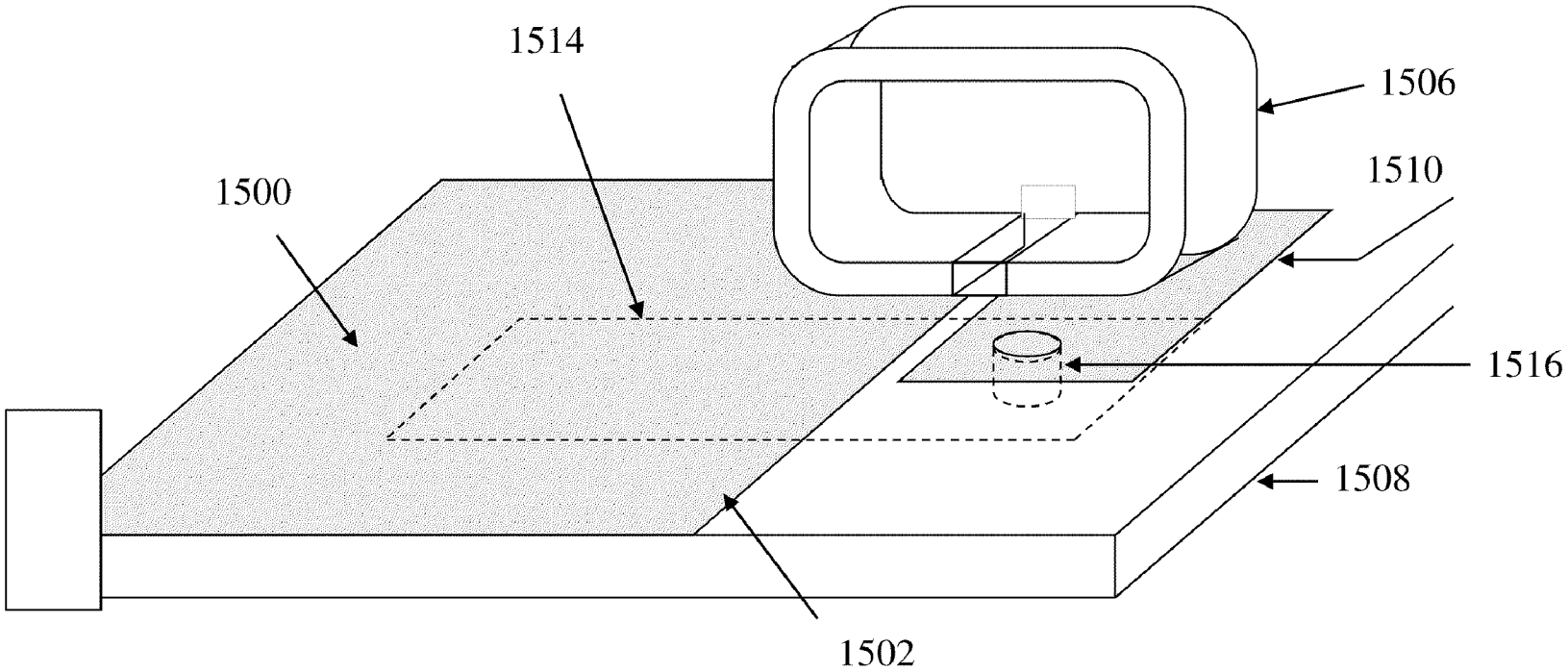
FIG. 15 shows features of one unit cell found in another printed circuit embodiment.

FIG. 15 shows another embodiment of a capacitively-loaded loop where the load capacitance is primarily provided by the parallel-plate capacitance between a lower layer patch 1514 and the ground plane 1500 on the upper layer of printed circuit board 1508.

Parallel-plate capacitance tuning is a tuning mechanism for Split Ring Resonators and such structures as well as other so-called Artificial Magnetic Molecules (AMM) could also be used as components of this edge diffraction system. Such artificial magnetic molecules are an example of metamaterials. The array of loops as described herein may also be considered a metamaterial with engineered effective anisotropic dispersive permeability.

Figure 16:
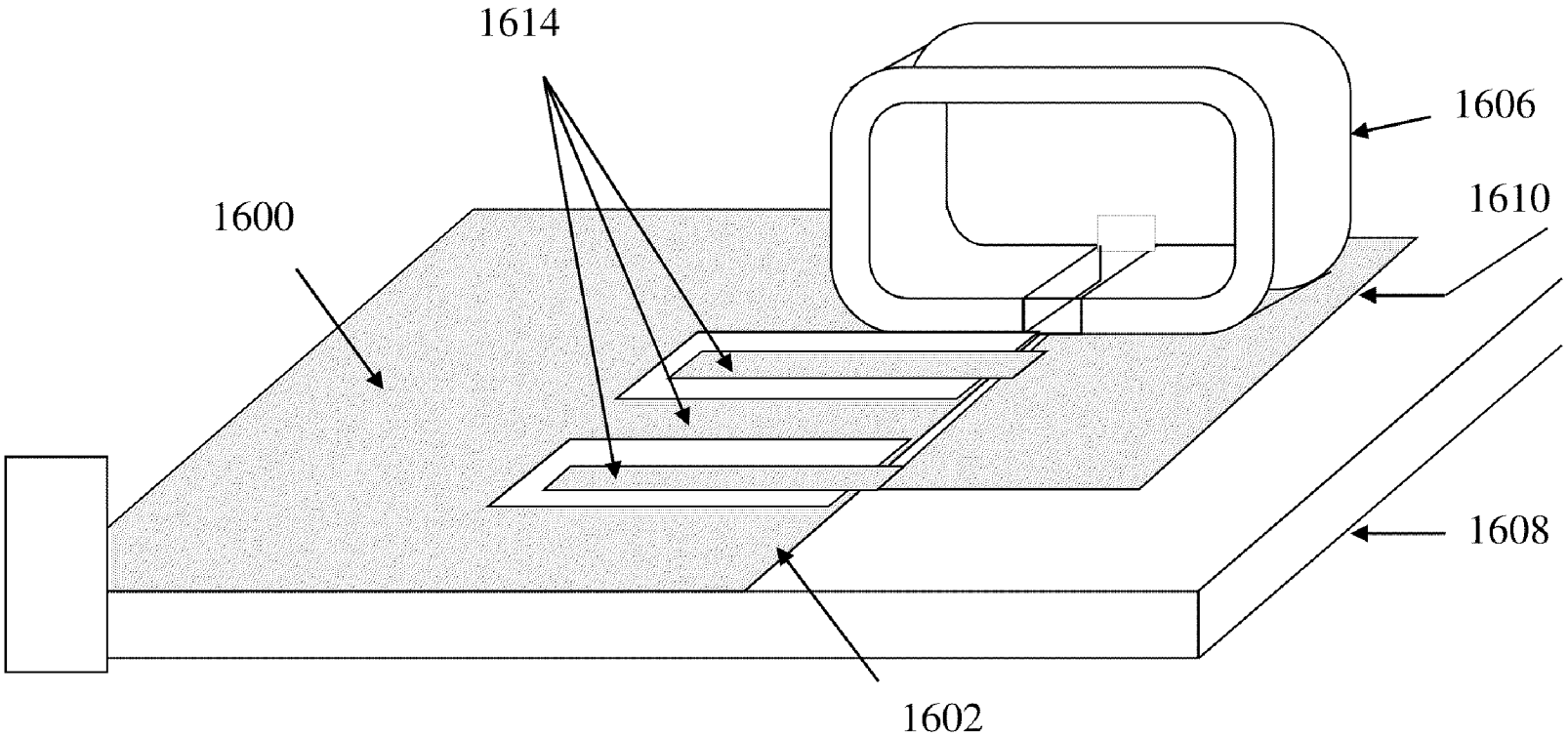
FIG. 16 shows features of one unit cell found in another printed circuit embodiment.

FIG. 16 illustrates yet another embodiment of a loaded loop in which an inter-digital capacitor 1614 is formed coplanar with the ground plane 1600 to provide the capacitive load.

Figure 17:
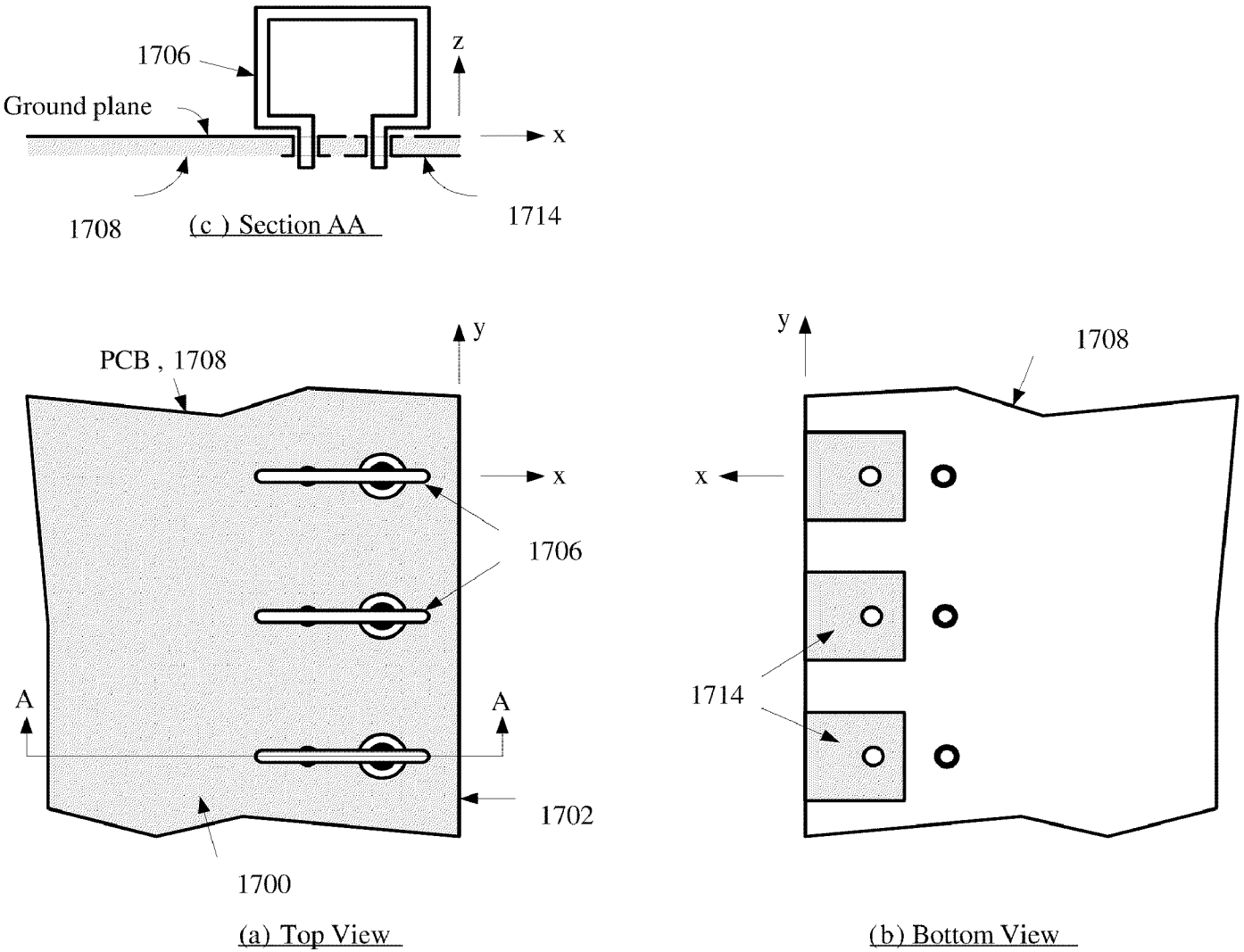
FIG. 17 shows another printed circuit embodiment.

FIG. 17 is similar to FIG. 15 in the capacitor concept as parallel patches 1714 are used to realize the load capacitance. However, the conductive loops 1706 are thru-hole mounted instead of being surface mounted.

Figure 18:
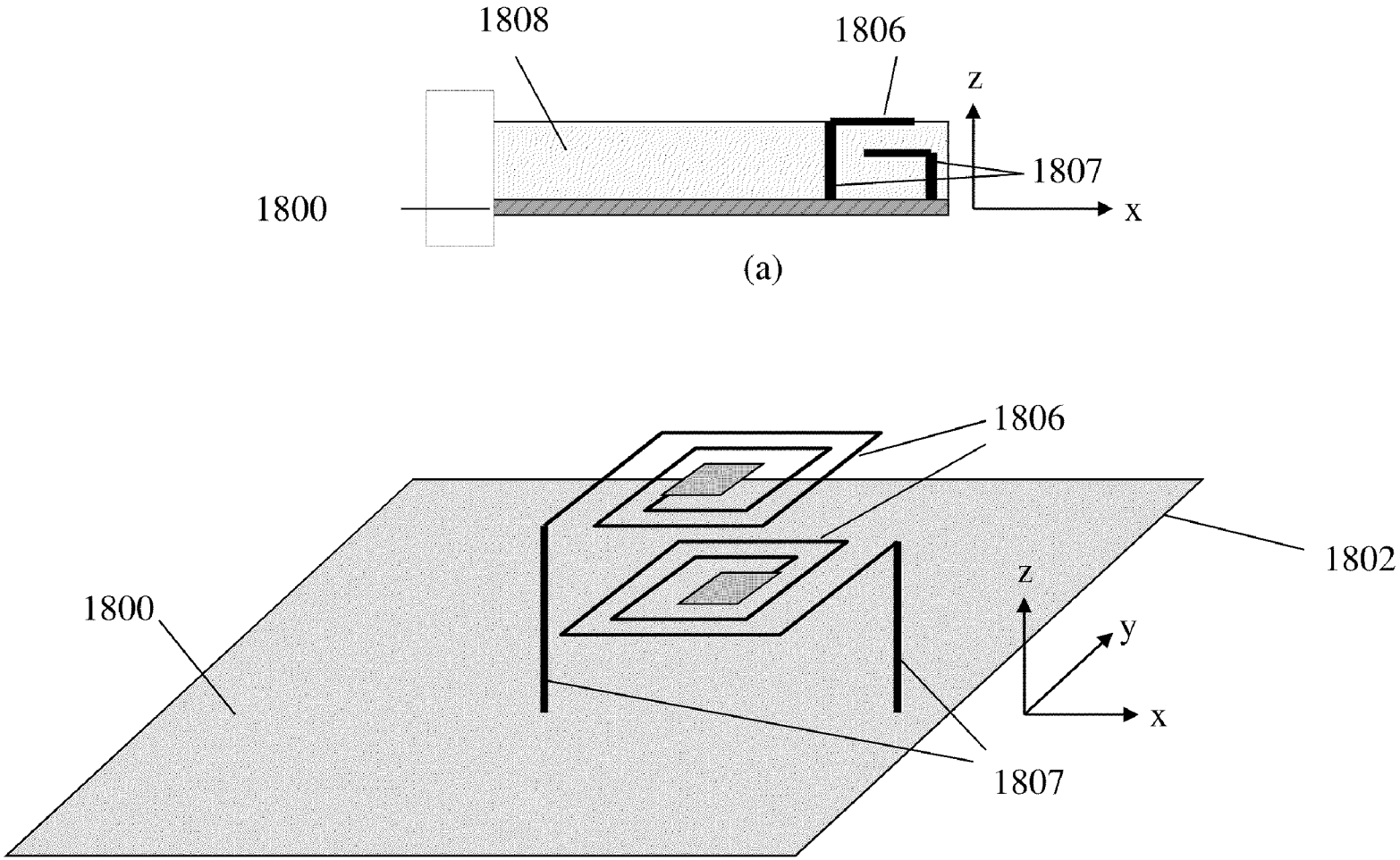
FIG. 18 shows features of one unit cell found in another printed circuit embodiment; and, FIG. 19 illustrates an antenna system using another embodiment where distributed capacitive loading is employed.

The arrays of resonant loops need not be disposed external to the printed wiring board. FIGS. 18(*a*) and 18(*b*) show a capacitively-loaded loop formed by two layers of spiral traces 1806 located in close proximity to each other and found on different metal layers in a printed wiring board. Vias 1807 connect the spiral traces to ground, thus forming closed loops. The vias 1807 may be thru vias, blind vias, or a combination of both. The example of FIG. 18 may have a metal layer ground plane 1800 attached to a dielectric substrate 1808.

Reactive edge treatments in the form of capacitively-loaded loops may be realized using any printed-wiring board technology including organic laminates, plastic laminates, ceramic substrates such as low temperature co-fired ceramics (LTCC), glass substrates, alumina, semiconductor substrates such as Si or GaAs, and the like.

The numerical examples shown above resonate near about 4 GHz, but that SRF may be lowered as far as desired for a particular application by increasing the loop dimensions and/or the load capacitance values. Conversely, the SRF may be increased into the millimeter wave bands and beyond by reducing dimensions and component values. The component values may be achieved by either distributed or lumped circuit elements. The resonant circuit may be comprised of both distributed and lumped circuit elements. Where a loop is described, it should be understood to comprise at least an inductive value and a capacitive value to form a resonant circuit. The term "loaded loop" is sometimes used to emphasize that the structure has both inductance and capacitance and achieves a self resonance, although the resonant frequency may be modified by the mutual impedance of adjacent loops or other components. The loading may include capacitors such as SMT chip capacitors, multi-turn inductive coils and the like.

Reducing the operational frequency of the loop reactive edge treatments to frequencies such as the HF band (3 MHz to 30 MHz) or the VHF bands (30 MHz to 300 MHz) requires a substantial increase in the LC product of the loaded loops. One means of achieving increased loop inductance is to add magnetically permeable material to the loops. Alternatively, the self inductance of individual loaded loops may be increased by placing a lumped discrete inductor in series with the loop. This may be achieved using SMT components on a printed wiring board implementation, or by fabricating a printed wiring board with meanderline inductors or spiral inductors as part of the interconnecting traces that form the loops. The loop portion of the inductive loading element may also be a multi-turn coil.

The loop reactive edge treatment may be used for antenna pattern control, such as sidelobe level reduction and backlobe level reduction; for improvement of antenna efficiency for body-worn antennas; for antenna pattern shaping for improved efficiency of feed antennas, mitigation of antenna mutual coupling between neighboring antennas; for suppression of electromagnetic interference (EMI), and the like. System applications for this reactive edge treatment may include all types of commercial and military command, control, and communication systems using antennas, such as handheld and portable RFID readers, wireless access points, MIMO antenna systems in high data rate mobile platforms, radar systems such as air traffic control, automotive, air-to air, and the like, and point-to-point terrestrial microwave links using reflector antennas.

Figure 19:
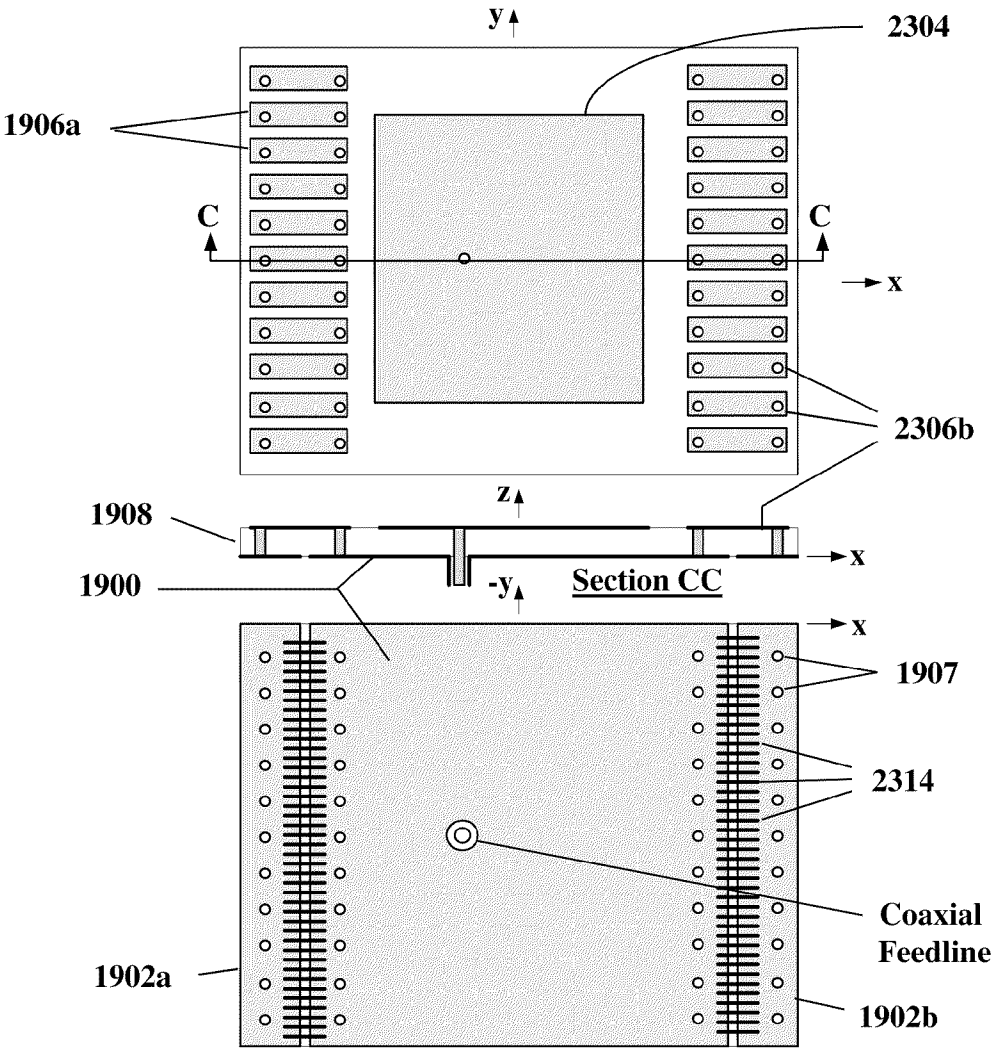

FIG. 19 shows an example of a printed antenna system that uses backlobe and sidelobe suppression. A probe fed patch antenna 1904 is printed on a dielectric substrate 1908 and driven against a backside ground plane 1900. Reduction of the hard diffraction coefficient along conductive edges 1902*a* and 1902*b* may be desired. Capacitively-loaded loops 1906*a* and 1906*b* are disposed on the edges by printing front side traces that run perpendicular to the edges and connecting these traces to the backside ground metal using thru-hole vias. The ground metal may be etched to create inter-digital capacitors that run along a substantial portion of the length of edges 1902*a* and 1902*b*. The two rows of inter-digital fingers 1914 realize a desired capacitance per unit length, which loads the loops formed by vias 1907 and the topside metal traces. The SRF of this linear array of loaded loops may be designed to be slightly lower than the intended operating band of the patch antenna so as to suppress diffracted waves. The loaded loops are disposed on the sides of the patch antenna that have radiating edges. FIG. 19 illustrates a linearly polarized antenna with only two radiating edges. A circularly polarized patch antenna may have reactive edge treatments on all four sides of a rectangular substrate, or the edge treatment may be found around the perimeter of a circular ground plane. The linear array of loops may be loaded with a distributed capacitance rather than lumped or discrete capacitors. In an aspect, the distributed capacitance required for loading the loops may also be realized with a long parallel-plate capacitor running parallel to the edge, assuming that an additional metal layer is available in the printed wiring board.

The above examples generally describe antennas where of loaded loop edge treatments are used and where the treatments are found in an external environment. However, the approach may be also be used for internal applications where EMI suppression is desired. In an aspect, multiple printed circuit boards may be stacked inside a metal enclosure such as in a blade server. Undesired coupling between circuits on different boards, or blades, may be reduced by using loaded loop reactive edge treatment at the edges of one or more printed circuit boards.

The steps for designing a reactive edge treatment for enhancement (suppression) of edge diffraction include: selecting an appropriate physical size and shape for the electrically-small loops at a desired operating frequency: the loop shapes may be any polygonal shape, and in the limit, curved such as circular or semi-circular, or the like; disposing the locations of the loops along the edge of a conductive wedge such that the normal axes of the loops are substantially parallel to the edge; selecting the self-resonant frequency of the array of loops to coincide with the upper (lower) edge of the frequency range where enhancement (suppression) is desired. Determining the position of the array of loops so that the loops are disposed less than about one free-space wavelength from the edge of the wedge at the loop self-resonant frequency. More than one row of capacitively-loaded loops may be used near the edge to achieve a multi-band response, as shown in FIG. 13. Numerical electromagnetic simulations may be used to confirm or optimize the desired performance.

In an aspect, different types of discrete capacitors and discrete inductors may be used in the embodiments of the loaded loops. The loops may be formed using square wire as opposed to round wire. The individual loops may be traces on printed wiring boards where the normals to the boards are oriented parallel to the edge. The patch layers may contain patterns more elaborate than simple rectangular patches, such as circular, polygonal, or even inter-digital patches. The ratios of dimensions shown in the figures are merely for illustrative purposes and do not serve to limit the physical appearance of any component. Furthermore, the realizations of the capacitively-loaded loop embodiments may involve the use of additional layers such as solder masks and metal platings in printed wiring boards to make a manufacturable product. The effect of these additional layers may be viewed as a perturbation to the coupling performance predicted by the above numerical methods.

Although only a few exemplary embodiments of this invention have been described in detail above, one will readily appreciate that many modifications are possible in the exemplary embodiments without materially departing from the novel teachings and advantages of the invention. Accordingly, all such modifications are intended to be included within the scope of this invention as defined in the following claims.

What is claimed is:

1. An antenna system, comprising: a conductive ground plane; an antenna positioned above the conductive ground plane; and, a reactive edge treatment comprising: an array of capacitively-loaded loops, wherein the capacitively-loaded loops are oriented such that a loop normal axis is parallel to an edge of the ground plane, wherein the loop is within approximately one wavelength at a design frequency.

2. The antenna system of claim 1 wherein a resonant frequency of a loop of the capacitively-loaded loops is a design frequency, and the design frequency is selected to be greater than an excitation frequency of the antenna system, so that the refractive edge treatment acts to increase an amplitude of electromagnetic energy diffracted from the edge at the excitation frequency.

3. The antenna system of claim 1 wherein a resonant frequency of a loop of the capacitively-loaded loops is a design frequency, and the design frequency is selected to be less than an excitation frequency of the antenna system, so that the refractive edge treatment acts to decrease an amplitude of electromagnetic energy diffracted from the edge at the excitation frequency.

4. The antenna system of claim 1 wherein a loop of the capacitively-loaded loops has at least one of a lumped-constant capacitor or a lumped constant inductor.

5. The antenna system of claim 1 wherein the array of capacitively-loaded loops is loaded with printed capacitors formed as at least one of a patch or an inter-digital capacitor.

6. The antenna system of claim 1 wherein the array of capacitively-loaded loops has a distributed capacitance in a direction parallel to the edge.

7. The antenna system of claim 1 wherein at least one of the capacitively-loaded loops of the array of loops is electrically isolated from the conductive ground plane.

8. The antenna system of claim 1 wherein at least one of the capacitively-loaded loops of the array of loops is electrically connected to the conductive ground plane.

9. The antenna system of claim 1 wherein the array of capacitively-loaded loops forms a substantially periodic structure along an edge of the ground plane.

10. The antenna system of claim 1 wherein the reactive edge treatment comprises a printed wiring board.

* * * * *